US007865105B2

(12) United States Patent
Abe

(10) Patent No.: US 7,865,105 B2
(45) Date of Patent: Jan. 4, 2011

(54) PRINTING CONTROL APPARATUS, PRINTING CONTROL METHOD, AND PROGRAM

(75) Inventor: Koichi Abe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 455 days.

(21) Appl. No.: 11/374,555

(22) Filed: Mar. 13, 2006

(65) Prior Publication Data

US 2006/0204270 A1 Sep. 14, 2006

(30) Foreign Application Priority Data

Mar. 14, 2005 (JP) ..... 2005-071734
Feb. 10, 2006 (JP) ..... 2006-034319

(51) Int. Cl.
*G03G 15/00* (2006.01)

(52) U.S. Cl. ..... 399/82; 399/83; 399/85; 399/364; 399/366; 399/367

(58) Field of Classification Search ..... 399/79–83, 399/85, 364, 366–367
See application file for complete search history.

(56) References Cited

U.S. PATENT DOCUMENTS 5,642,205 A * 6/1997 Kassmann ..... 358/468
6,169,873 B1 * 1/2001 Connolly ..... 399/365
6,424,429 B1 * 7/2002 Takahashi et al. ..... 358/1.16
6,463,435 B1 * 10/2002 Bergmans ..... 707/9
6,557,965 B2 * 5/2003 Walker et al. ..... 347/16
6,646,758 B1 * 11/2003 Anderson et al. ..... 358/1.15
7,206,068 B2 * 4/2007 Suzuki ..... 356/244
7,268,909 B2 * 9/2007 Nakagiri ..... 358/1.16
2001/0053295 A1 * 12/2001 Kujirai et al. ..... 399/79
2003/0067629 A1 * 4/2003 Sugishita ..... 358/1.15
2003/0113130 A1 * 6/2003 Robertson et al. ..... 399/82
2004/0190926 A1 * 9/2004 Burkes et al. ..... 399/82
2005/0030333 A1 * 2/2005 Takahashi et al. ..... 347/19

FOREIGN PATENT DOCUMENTS

JP 3380598 12/2002
JP 2005-047029 A 2/2005

OTHER PUBLICATIONS

English translation of Hitara et al., JP publication 06-089056, published Mar. 29, 1994.*
The above reference was cited in a Oct. 22, 2010 Japanese Office Action, a copy of which is enclosed without English Translation, that issued in Japanese Patent Application No. 2006-034319.

* cited by examiner

*Primary Examiner*—David M Gray
*Assistant Examiner*—Geoffrey T Evans
(74) *Attorney, Agent, or Firm*—Cowan, Liebowitz & Latman, P.C.

(57) ABSTRACT

A duplex printing instruction is accepted. When duplex printing is performed in accordance with the single-side printing and duplex printing is performed for a job of one page is decided in accordance with a condition.

6 Claims, 36 Drawing Sheets

FIG. 10

| COMMAND ID | PRINT MODE | PAGE SETUP | ROTATION CONTROL | DISCHARGE CONTROL |
|---|---|---|---|---|

COMMAND ID:
- 0008 [HEX] ··· SINGLE-SIDE / DUPLEX PRINTING CONTROL COMMAND

PRINT MODE:
- 0010 [HEX] ··· SINGLE-SIDE PRINTING (DUPLEX PRINTING : OFF)
- 0020 [HEX] ··· MANUAL DUPLEX PRINTING
- 0030 [HEX] ··· AUTOMATIC DUPLEX PRINTING

PAGE SETUP:
- PRINT MODE : 0020 [HEX]
  - 0001~FFFE [HEX] ··· PAGES ARE REVERSED AFTER SET PAGES
  - FFFF [HEX] ··· NUMBER OF PAGES TO BE REVERSED IS UNKNOWN
- PRINT MODE : OTHER THAN 0020 [HEX]
  - 0001~FFFE [HEX] ··· TOTAL NUMBER OF PRINT PAGES
  - FFFF [HEX] ··· TOTAL NUMBER OF PRINT PAGES IS UNKNOWN

ROTATION CONTROL:
- PRINT MODE : 0010 [HEX]
  - 0000[HEX] ··· DEFAULT VALUES (ROTATION AXIS OF PAPER : NO ROTATION, MEDIA TYPE : NOT DESIGNATED, ORIENTATION : NOT DESIGNATED)
- PRINT MODE : OTHER THAN 0010 [HEX]
  - ROTATION AXIS OF PAPER:
    - 0000 [HEX] ··· NO ROTATION
    - 1000 [HEX] ··· ROTATE ALONG AXIS PERPENDICULAR TO PAPER FEED DIRECTION
    - 2000 [HEX] ··· ROTATE ALONG AXIS PARALLEL TO PAPER FEED DIRECTION
    - 3000 [HEX] ··· ROTATE ALONG AXIS PERPENDICULAR TO PAPER SURFACE
  - MEDIA TYPE:
    - 0000 [HEX] ··· NOT DESIGNATED
    - 0100 [HEX] ··· VERTICAL FORMAT
    - 0200 [HEX] ··· HORIZONTAL FORMAT
    - 0300 [HEX] ··· ASPECT RATIO OF 1 : 1
  - ORIENTATION:
    - 0000 [HEX] ··· NOT DESIGNATED
    - 0010 [HEX] ··· PORTRAIT
    - 0020 [HEX] ··· LANDSCAPE

DISCHARGE CONTROL:
- PRINT MODE : 0030 [HEX]
  - 0000 [HEX] ··· NOTHING IS DONE IN PRINTER
  - 1000 [HEX] ··· WHEN ODD-NUMBERED PAGES ARE PRINTED, FINAL PAGE IS AUTOMATICALLY DISCHARGED VIA AUTOMATIC DUPLEX UNIT IN PRINTER
  - 2000 [HEX] ··· WHEN THREE OR MORE ODD-NUMBERED PAGES ARE PRINTED, FINAL PAGE IS AUTOMATICALLY DISCHARGED VIA AUTOMATIC DUPLEX UNIT IN PRINTER
- PRINT MODE : OTHER THAN 0030 [HEX]
  - 0000 [HEX] ··· DEFAULT VALUES (NOTHING IS DONE IN PRINTER)

FIG. 11

| COMMAND ID | COLOR | DATA LENGTH | PRINT PULSE DATA |
|---|---|---|---|

COMMAND ID : 000A [HEX] ··· PRINT PULSE CONTROL COMMAND

COLOR : 0010 [HEX] ··· CYAN
0020 [HEX] ··· MAGENTA
0030 [HEX] ··· YELLOW
0040 [HEX] ··· BLACK

DATA LENGTH : 0000~FFFF [HEX] ··· LENGTH (NUMBER OF BYTES) OF PRINT PULSE DATA

PRINT PULSE DATA : PRINT PULSE DATA (BINARY DATA) FORMED FROM NUMBER OF BYTES BY DATA LENGTH

FIG. 12

| COMMAND ID | PAGE NUMBER | TOTAL NUMBER OF PAGES | START / END |
|---|---|---|---|

COMMAND ID :
000C [HEX] ··· PAGE CONTROL COMMAND

PAGE NUMBER :
1000～FFFE [HEX] ··· PAGE NUMBER DURING PRINTING

TOTAL NUMBER OF PAGES :
1000～FFFE [HEX] ··· TOTAL NUMBER OF PRINT PAGES
FFFF [HEX] ··· TOTAL NUMBER OF PRINT PAGES IS UNKNOWN

START / END :
0000 [HEX] ··· START
0001 [HEX] ··· END

FIG. 13

[EXAMPLE OF SINGLE-SIDE PRINTING CONTROL COMMAND]

| | | |
|---|---|---|
| PRINT SETTINGS (Page Setup) : | Page Size : | Letter |
| | Orientation: | Portrait |
| | Duplex Printing: | Off (SINGLE-SIDE PRINTING) |

TOTAL NUMBER OF PRINT PAGES : 5

CONTROL COMMAND : 0008 0010 0005 0000 0000

FIG. 14

[EXAMPLE OF MANUAL DUPLEX PRINTING CONTROL COMMAND]

| | | |
|---|---|---|
| PRINT SETTINGS (Page Setup) : | Page Size : | Letter |
| | Orientation : | Portrait |
| | Duplex Printing : | On (DUPLEX PRINTING) |
| | Automatic : | Off (MANUAL) |
| | Staple Side : | Long-side stapling |
| TOTAL NUMBER OF PRINT PAGES : 5 | | |
| CONTROL COMMAND : | 0008 0020 0003 2110 0000 | |

FIG. 15

[EXAMPLE OF AUTOMATIC DUPLEX PRINTING CONTROL COMMAND]

| | | |
|---|---|---|
| PRINT SETTINGS : | Page Size : | Letter |
| | Orientation : | Portrait |
| | Duplex Printing : | On (DUPLEX PRINTING) |
| | Automatic : | On (AUTOMATIC) |
| | Staple Side : | Long-side stapling |
| | SETTING OF AUTOMATIC DUPLEX PRINTING : | ALWAYS DUPLEX |
| TOTAL NUMBER OF PRINT PAGES : | 5 | |
| CONTROL COMMAND : | 0008 0030 0005 2110 2000 | |

FIG. 16

| No. | Print Image Data | PRINT SETTINGS | | | PRINT MODE |
|---|---|---|---|---|---|
| | | Page Size | Media Type | Print Quality | |
| 1 | Color Image | Letter | Plain Paper | High | SINGLE-SIDE PRINTING |
| 2 | Color Image | Letter | Plain Paper | Standard | SINGLE-SIDE PRINTING |
| 3 | Color Image | Letter | Plain Paper | Fast | AUTOMATIC DUPLEX PRINTING |
| 4 | Color Image | A4 | Plain Paper | High | SINGLE-SIDE PRINTING |
| 5 | Color Image | A4 | Plain Paper | Standard | SINGLE-SIDE PRINTING |
| 6 | Color Image | A4 | Plain Paper | Fast | AUTOMATIC DUPLEX PRINTING |
| 7 | Monochrome Text | Letter | Plain Paper | High | SINGLE-SIDE PRINTING |
| 8 | Monochrome Text | Letter | Plain Paper | Standard | AUTOMATIC DUPLEX PRINTING |
| 9 | Monochrome Text | Letter | Plain Paper | Fast | AUTOMATIC DUPLEX PRINTING |
| 10 | Monochrome Text | A4 | Plain Paper | High | SINGLE-SIDE PRINTING |
| 11 | Monochrome Text | A4 | Plain Paper | Standard | AUTOMATIC DUPLEX PRINTING |
| 12 | Monochrome Text | A4 | Plain Paper | Fast | AUTOMATIC DUPLEX PRINTING |
| 13 | Color Image | Hagaki 100x148mm | Hagaki | High | AUTOMATIC DUPLEX PRINTING |
| 14 | Color Image | Hagaki 100x148mm | Hagaki | Standard | AUTOMATIC DUPLEX PRINTING |
| 15 | Color Image | Hagaki 100x148mm | Hagaki | Fast | AUTOMATIC DUPLEX PRINTING |
| 16 | Monochrome Text | Hagaki 100x148mm | Hagaki | High | AUTOMATIC DUPLEX PRINTING |
| 17 | Monochrome Text | Hagaki 100x148mm | Hagaki | Standard | AUTOMATIC DUPLEX PRINTING |
| 18 | Monochrome Text | Hagaki 100x148mm | Hagaki | Fast | AUTOMATIC DUPLEX PRINTING |
| 19 | Color Image | Hagaki 100x148mm | Ink Jet Hagaki | High | AUTOMATIC DUPLEX PRINTING |
| 20 | Color Image | Hagaki 100x148mm | Ink Jet Hagaki | Standard | AUTOMATIC DUPLEX PRINTING |
| 21 | Color Image | Hagaki 100x148mm | Ink Jet Hagaki | Fast | AUTOMATIC DUPLEX PRINTING |
| 22 | Monochrome Text | Hagaki 100x148mm | Ink Jet Hagaki | High | AUTOMATIC DUPLEX PRINTING |
| 23 | Monochrome Text | Hagaki 100x148mm | Ink Jet Hagaki | Standard | AUTOMATIC DUPLEX PRINTING |
| 24 | Monochrome Text | Hagaki 100x148mm | Ink Jet Hagaki | Fast | AUTOMATIC DUPLEX PRINTING |

FIG. 29

START ADDRESS OF PRINT PULSE CONTROL COMMAND :

| | | | | | | | | | | | | | | | | |
|---|---|---|---|---|---|---|---|---|---|---|---|---|---|---|---|---|
| 0x80000000 : | 00 | 0A | 00 | 10 | 20 | 48 | 00 | 00 | 00 | 00 | ··· | 00 | 00 | 00 | 00 |
| 0x80002054 : | 00 | 0A | 00 | 20 | 20 | 48 | 00 | 00 | 00 | 00 | ··· | 00 | 00 | 00 | 00 |
| 0x80004108 : | 00 | 0A | 00 | 30 | 20 | 48 | 00 | 00 | 00 | 00 | ··· | 00 | 00 | 00 | 00 |
| 0x80006162 : | 00 | 0A | 00 | 10 | 20 | 48 | F8 | 00 | 00 | 00 | ··· | 00 | 00 | 00 | 00 |
| 0x80008216 : | | | | | | | | | | | | | | | |

FIG. 36

| APPLICATION NAME | GROUP NAME |
|---|---|
| Application 1 | Group 1 |
| Application 2 | Group 1 |
| Application 3 | Group 1 |
| Application 4 | Group 2 |
| Application 5 | Group 2 |
| Application 6 | Group 2 |
| Application 7 | Group 3 |
| Application 8 | Group 3 |
| Application 9 | Group 3 |
| Application 10 | Group 3 |

PRINTING CONTROL APPARATUS, PRINTING CONTROL METHOD, AND PROGRAM

FIELD OF THE INVENTION

The present invention relates to a printing technique.

BACKGROUND OF THE INVENTION

In general, when automatic duplex printing is performed, the followings are important for the print result:

(1) Which of the front and back sides of discharged paper faces up?

(2) Can the user obtain an expected print result?

In conventional automatic duplex printing, for example, if a document of one page is printed in automatic duplex printing setting by erroneous user operation, printing is done in either fixed print mode depending on the printer driver: the print mode of duplex printing or the print mode of general single-side printing. Examples of printing in this case are as follows.

[Example of Printer Driver A]

When a document of one page is printed in automatic duplex printing setting, no paper sheet is discharged upon the completion of printing one page. The paper sheet is reversed via an automatic duplex unit, and then discharged. Compared to general single-side printing, the paper sheet is discharged onto the discharge tray with its front and back sides being reversed. An image process for printing that is executed in printing one page is one for duplex printing (the print density is slightly low (low quality) so as to prevent setoff).

<Advantage>

When a plurality of print jobs are printed at automatic duplex printing setting and contain a print job of one page, printed products are discharged onto the discharge tray with the image-bearing surfaces (which of the front and back sides faces up?) of all the printed products (discharged paper sheets) being unified.

<Disadvantage>

The print quality of 1-page printing becomes the quality (poor quality) of duplex printing.

[Example of Printer Driver B]

When a document of one page is printed in automatic duplex printing setting, printing is controlled to discharge a paper sheet through the same path as that of general single-side printing without the mediacy of the automatic duplex unit. An image process for 1-page printing is one for general single-side printing (high quality).

<Advantage>

The print quality of 1-page printing becomes the quality (high quality) of single-side printing.

<Disadvantage>

When a plurality of print jobs are printed in automatic duplex printing setting and contain a print job of one page, the orientation (which of the front and back sides faces up?) of a printed product for the print job of one page becomes opposite to those of the remaining print jobs. The printed products are discharged onto the discharge tray without unifying their image-bearing surfaces.

When a 1-page document is printed in automatic duplex printing setting, some applications output a blank page (no print image data) as the second page to the printer driver.

As a prior art, there is a technique as disclosed in Japanese Patent Registration No. 03380598.

In the former case of the prior art, a comparison between the example of printer driver A and that of printer driver B shows that each example has both a contradictory advantage and disadvantage. No optimal print result can always be obtained in all cases of automatic duplex printing. In some cases, the print result falls short of user's expectation, as described in the disadvantage.

In the latter case of the prior art, a print job of originally one page is processed as printing of two pages in which the second page is a blank page (no print image data). This results in a case as described in the disadvantage in the example of printer driver A. The print result falls short of user's expectation,

SUMMARY OF THE INVENTION

The present invention has been made to overcome the conventional drawbacks, and has as its object to provide a technique of performing preferable printing control for each print job when automatic duplex printing is executed.

In order to achieve an object of the present invention, for example, a printing control apparatus of the present invention comprises the following arrangement.

That is, a printing control apparatus comprising:

acceptance unit adapted to accept a duplex printing instruction; and decision unit adapted to decide, in accordance with a condition, which of single-side printing and duplex printing is performed for a job of one page when duplex printing is performed in accordance with the duplex printing instruction accepted by the acceptance unit.

In order to achieve an object of the present invention, for example, a printing control apparatus of the present invention comprises the following arrangement.

That is, a printing control apparatus comprising:

a comparison unit adapted to compare a current job in process with a previous job; and a decision unit adapted to decide, in accordance with a comparison result of the comparison unit, which of duplex printing in which duplex printing is always done and duplex printing in which single-side printing is done depending on a condition is performed for the current job in process.

In order to achieve an object of the present invention, for example, a printing control method of the present invention comprises the following arrangement.

That is, a printing control method comprising:

a determination step of determining a duplex printing instruction; and a decision step of deciding, in accordance with a condition, which of single-side printing and duplex printing is performed for a job of one page when duplex printing is performed in accordance with the duplex printing instruction determined in the determination step.

In order to achieve an object of the present invention, for example, a printing control method of the present invention comprises the following arrangement.

That is, a printing control method comprising:

a comparison step of comparing a current job in process with a previous job; and a decision step of deciding, in accordance with a comparison result in the comparison step, which of duplex printing in which duplex printing is always done and duplex printing in which single-side printing is done depending on a condition is performed for the current job in process.

In order to achieve an object of the present invention, for example, a program of the present invention comprises the following arrangement.

That is, a program causing a computer to execute a determination step of determining a duplex printing instruction, and a decision step of deciding, in accordance with a condition, which of single-side printing and duplex printing is performed for a job of one page when duplex printing is performed in accordance with the duplex printing instruction determined in the determination step.

In order to achieve an object of the present invention, for example, a program of the present invention comprises the following arrangement.

That is, a program causing a computer to execute a comparison step of comparing a current job in process with a previous job, and a decision step of deciding, in accordance with a comparison result in the comparison step, which of duplex printing in which duplex printing is always done and duplex printing in which single-side printing is done depending on a condition is performed for the current job in process.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 10 is a view showing a single-side/duplex printing control command;

FIG. 11 is a view showing a print pulse control command;

FIG. 12 is a view showing a page control command;

FIG. 13 is a view showing an example of a control command for single-side printing;

FIG. 14 is a view showing an example of a control command for manual duplex printing;

FIG. 15 is a view showing an example of a control command for automatic duplex printing;

FIG. 16 is a table showing an example of the structure of a print mode control table which is referred to in order to decide a print mode using print image data or print settings in a print job when automatic duplex printing is selected;

FIG. 29 is a view showing part of the memory map of a RAM 17;

FIG. 36 is a table showing the correspondence between the application and the group.

DETAILED DESCRIPTION OF THE PREFERRED EMBODIMENT

A preferred embodiment of the present invention will now be described in detail in accordance with the accompanying drawings.

<System Configuration>

Figure 1:
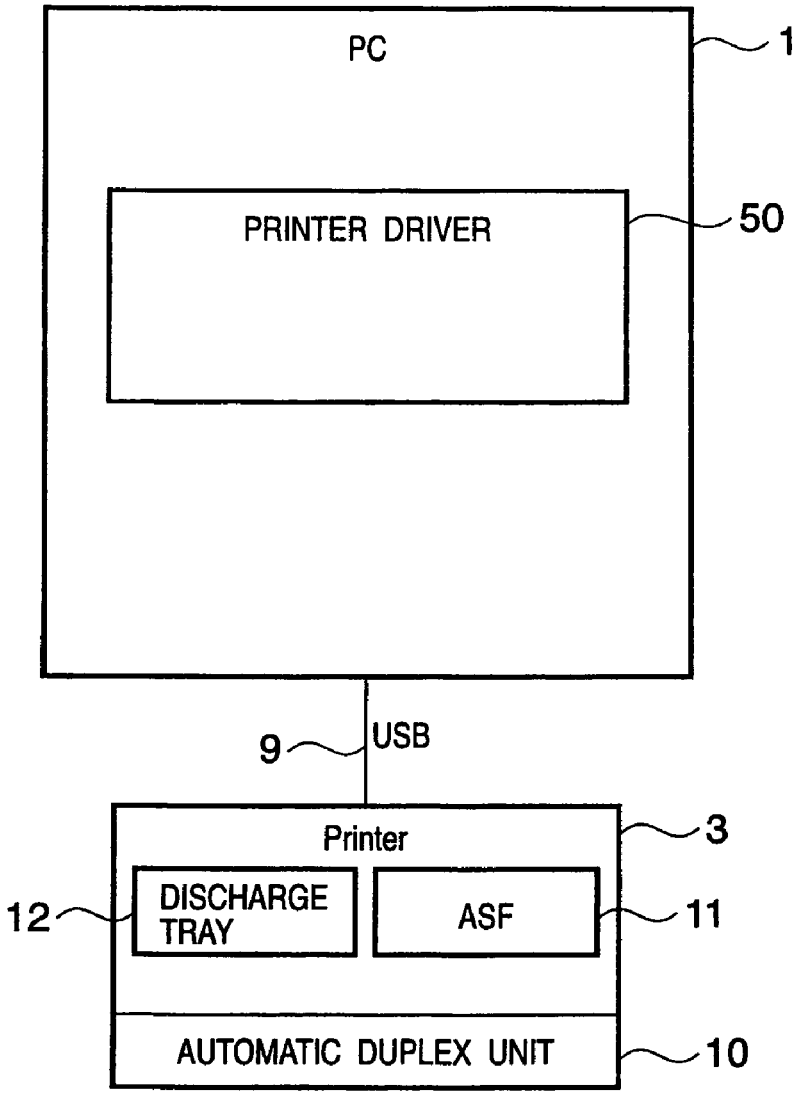
FIG. 1 is a block diagram showing the functional configuration of a print system according to an embodiment of the present invention.

FIG. 1 is a block diagram showing the functional configuration of a print system according to the embodiment. As shown in FIG. 1, the system according to the embodiment comprises a PC (Personal Computer) 1 and printer 3.

The PC 1 is formed from hardware (to be described later with reference to FIG. 2). As an OS (Operating System), Windows XP® available from Microsoft® is installed in the PC 1.

The printer 3 is assumed to be a color ink-jet printer The printer 3 is formed from hardware (to be described later with reference to FIG. 3), connected to the PC 1 via a USB (Universal Serial Bus) cable 9, and can communicate with the PC 1 in two directions.

Reference numeral 50 denotes a printer driver which is installed in the PC 1 and controls the printer 3 from the OS of the PC 1. Details of the printer driver 50 will be described later with reference to FIG. 4. Reference numeral 10 denotes an automatic duplex unit which is detachably mounted in the printer 3. By mounting the automatic duplex unit 10 in the printer 3, the printer 3 can automatically perform duplex printing from an application installed in the OS of the PC 1. This function of automatically performing duplex printing will be called automatic duplex printing. In the embodiment, the automatic duplex unit 10 is mounted in the printer 3. Reference numeral 11 denotes an auto sheet feeder (ASF) in which print sheets (paper sheets) are set. Reference numeral 12 denotes a discharge tray onto which a printed sheet (paper sheet) is discharged.

<Configuration of PC 1>

Figure 2:
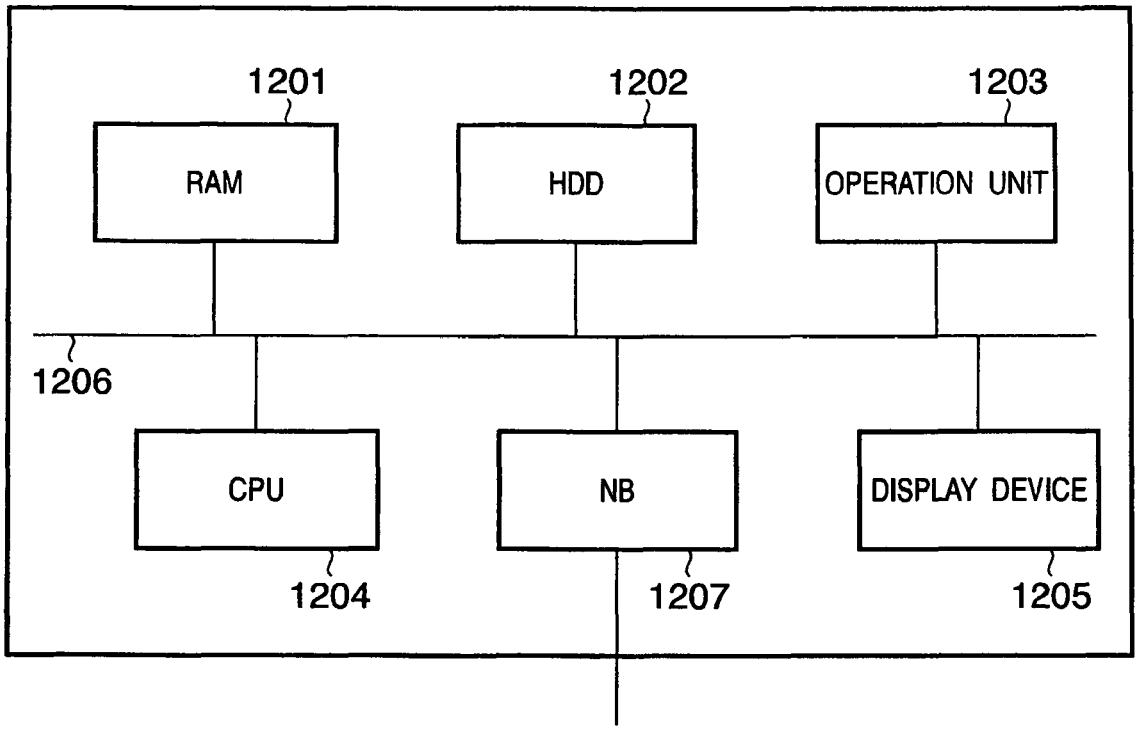
FIG. 2 is a block diagram showing the hardware configuration of a PC 1.

FIG. 2 is a block diagram showing the hardware configuration of the PC 1. Note that a computer such as a WS (Work Station) may be used instead of the PC 1 as far as the computer has the same configuration.

Reference numeral 1201 denotes a RAM which can provide various areas including an area for temporarily storing programs and data loaded from an HDD (Hard Disk Drive) 1202, and a work area used to execute various processes by a CPU 1204.

The HDD 1202 saves the OS, the printer driver 50 of the printer 3, various application programs, and various data created by the application programs, which are loaded into the RAM 1201 under the control of the CPU 1204 and subjected to processes by the CPU 1204.

Reference numeral 1203 denotes an operation unit which is made up of a keyboard, mouse, and the like. The operator can operate the operation unit 1203 to input various instructions to the CPU 1204.

The CPU 1204 controls the overall PC 1, and executes processes (to be described later) performed by the PC 1.

Reference numeral 1205 denotes a display device which is made up of a CRT, liquid crystal screen, and the like, and displays a process result by the CPU 1204 as an image, text, or the like.

Reference numeral 1207 denotes an NB (Network Board) which controls data communication with the printer 3 via the USB cable 9.

The above-mentioned units are connected to a common bus and can exchange data. The configuration of the PC 1 is not limited to this, and may further comprise a drive device for reading out programs and data recorded on a recording medium such as a CD-ROM or DVD-ROM.

<Configuration of Printer 3>

Figure 3:
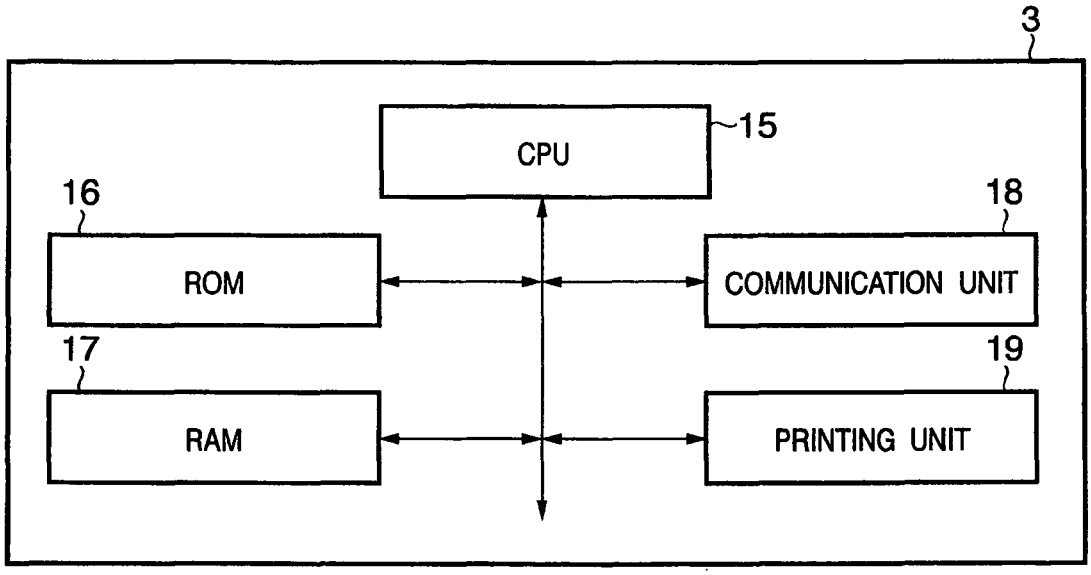
FIG. 3 is a block diagram showing the hardware configuration of a printer 3.

FIG. 3 is a block diagram showing the hardware configuration of the printer 3. Reference numeral 15 denotes a CPU which is formed from a microprocessor or the like. The CPU 15 controls the building units of the printer 3 by using programs and data stored in a ROM 16, and executes processes (to be described later) performed by the printer 3.

The ROM 16 stores a program which is executed by the CPU 15 in order to perform a print process by the printer 3 under the control of the printer driver 50 (to be described later with reference to FIG. 4). A RAM 17 temporarily stores data transmitted mainly from the PC 1. A communication unit 18 includes a connection port for the USB cable 9, and controls communication via the USB cable 9. A printing unit 19 is made up of a print unit and an electrical circuit. The print unit includes an ink-jet printhead, color inks, a carriage, and a print sheet convey mechanism. The electrical circuit includes an ASIC for causing the printhead to generate a print pulse on the basis of print data transmitted from the PC 1.

The display contents (image data) of a file opened by an application are temporarily stored as an EMF spool file in the HDD 1202 of the PC 1 by a print operation on the application. The image data is converted via the printer driver 50 into print data (print pulse control command to be described later with reference to FIG. 11) containing a command for controlling the printer 3. The print data is transmitted to the printer 3 via the USB cable 9. The print data (print pulse control command) received by the printer 3 is converted into a print pulse by the printing unit 19, and printed on a print sheet.

<Configuration of Printer Driver 50>

Figure 4:
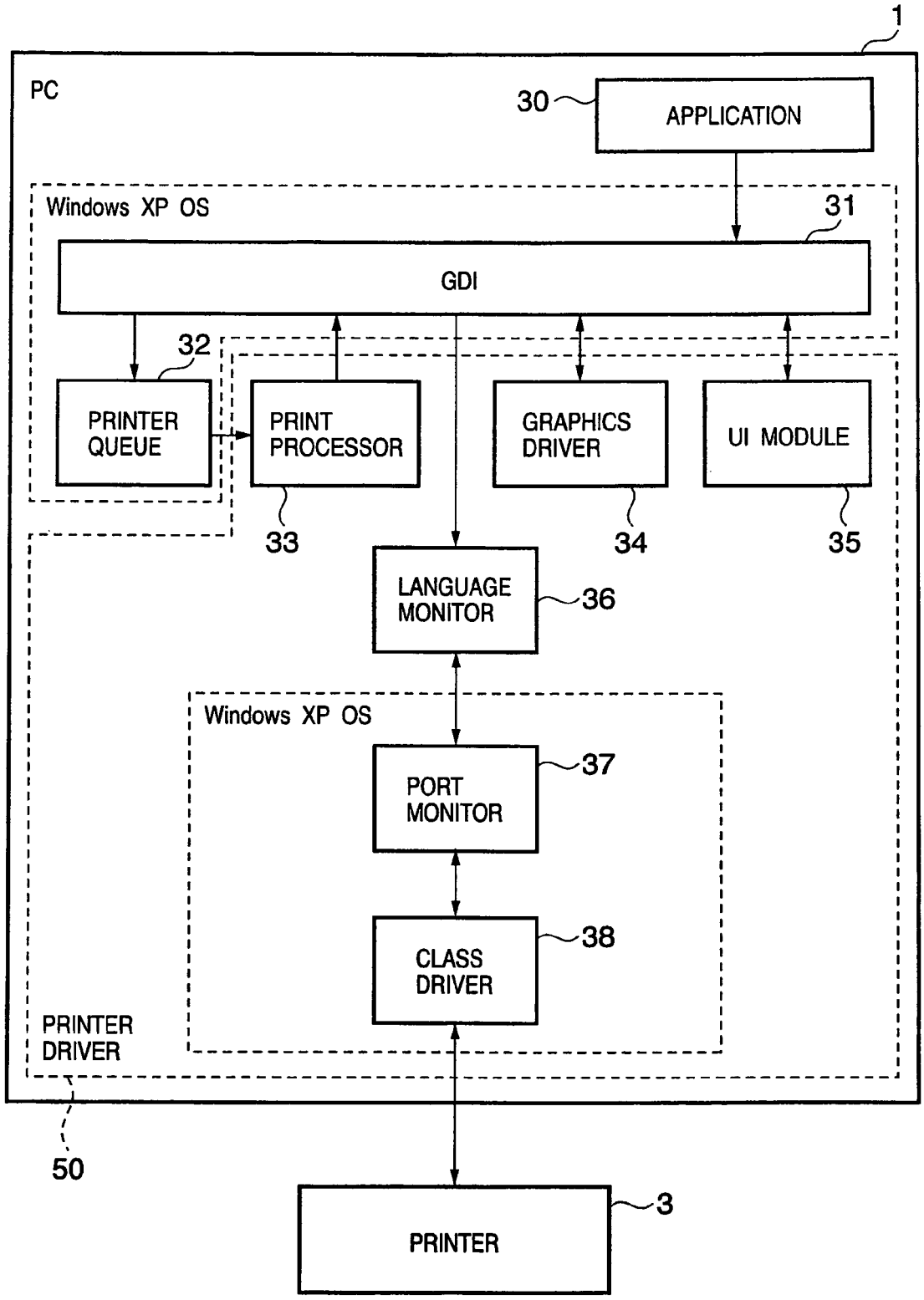
FIG. 4 is a block diagram showing the functional configuration of a printer driver 50 installed in an HDD 1202.

FIG. 4 is a block diagram showing the functional configuration of the printer driver 50 installed in the HDD 1202. As shown in FIG. 4, the printer driver 50 is installed in the PC 1, and comprises a plurality of modules 33 to 36.

An application 30 is application software capable of displaying a print instruction and the state of the printer. The application 30 corresponds to, e.g., Notepad (Notepad.exe) which is a text editor normally packaged in the Windows XP® OS. In the embodiment, Notepad (Notepad.exe) (to be described later with reference to FIG. 5) is used as an example of the application 30. Reference numeral 31 denotes a GDI (Graphics Device Interface) which is part of the Windows XP® OS. Reference numeral 32 denotes a printer queue which is part of the spooler of the Windows XP® OS and queues a print job.

The configuration of the printer driver 50 will be explained. The print processor 33 performs a change of the print layout and a special process for a print image. The graphics driver 34 operates as the core of an image process by the printer driver 50, performs a print image process on the basis of a drawing instruction sent from the GDI 31, and creates a print control command. The UI (User Interface) module 35 provides and controls the UI of the printer driver 50. The language monitor (to be also simply referred to as an LM hereinafter) 36 functions as a data communication I/F to control transmission/reception of data. Reference numeral 37 denotes a port monitor which transmits data sent from the LM 36 to a proper port, and receives data sent from the printer 3 via a class driver 38. The class driver 38 is a low-level module nearest to the port, corresponds to a printer-class driver of the USB cable 9, and controls a port (USB port in the embodiment).

<Dialog Associated with Printing>

Figure 5:
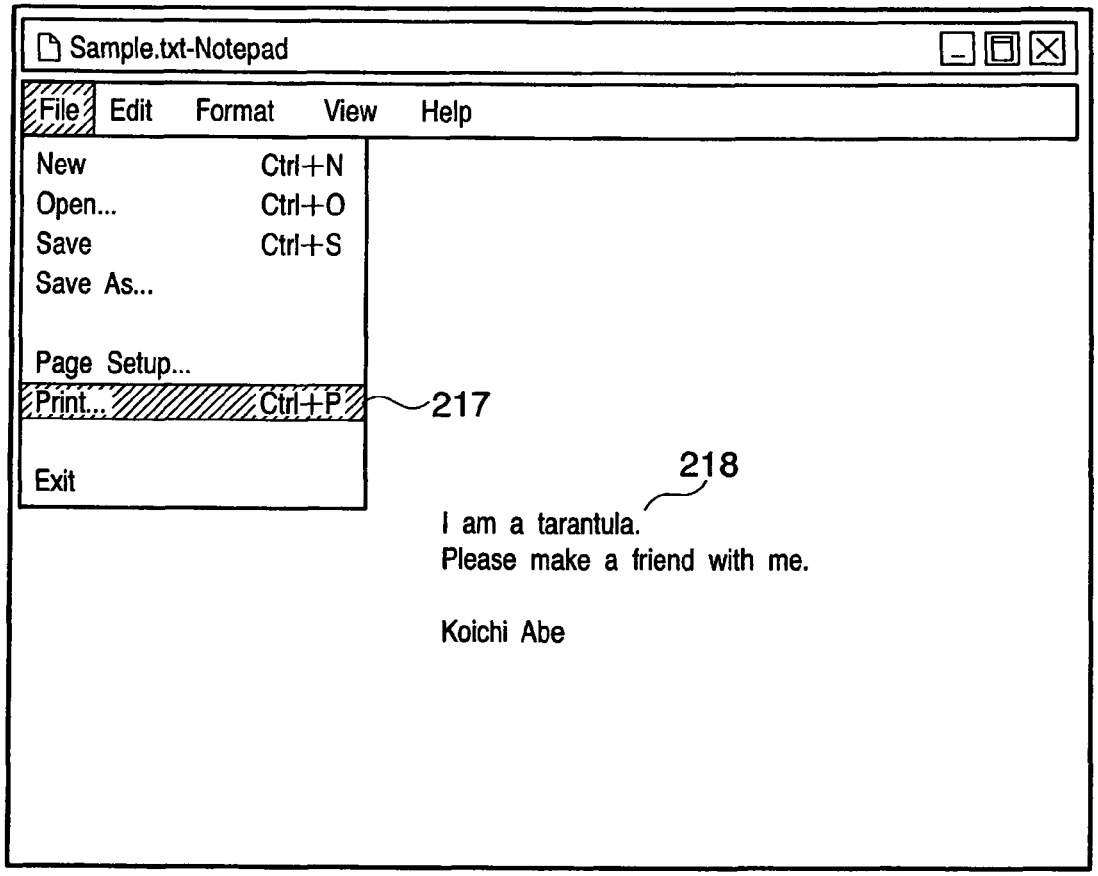
FIG. 5 is a view showing a display example when printing is done from a text editor Notepad (Notepad.exe) which is installed as a standard application in the Windows XP® OS.

FIG. 5 is a view showing a display example when printing is done from the text editor Notepad (Notepad.exe) which is installed as a standard application in the Windows XP® OS. The display in FIG. 5 is provided on the display screen of the display device 1205.

In the following description, all dialogs are displayed on the display screen of the display device 1205. An operation to the following dialog is done using the keyboard or mouse, and all processes which reflect the operation are executed by the CPU 1204.

The operator uses the keyboard or mouse to select a print menu (Print . . . ) 217 from the File menu in FIG. 5. Then, the CPU 1204 detects this operation, and starts a print process for the display contents of a text displayed in a text display area 218. The CPU 1204 first displays a dialog shown in FIG. 6 on the display screen of the display device 1205.

Figure 6:
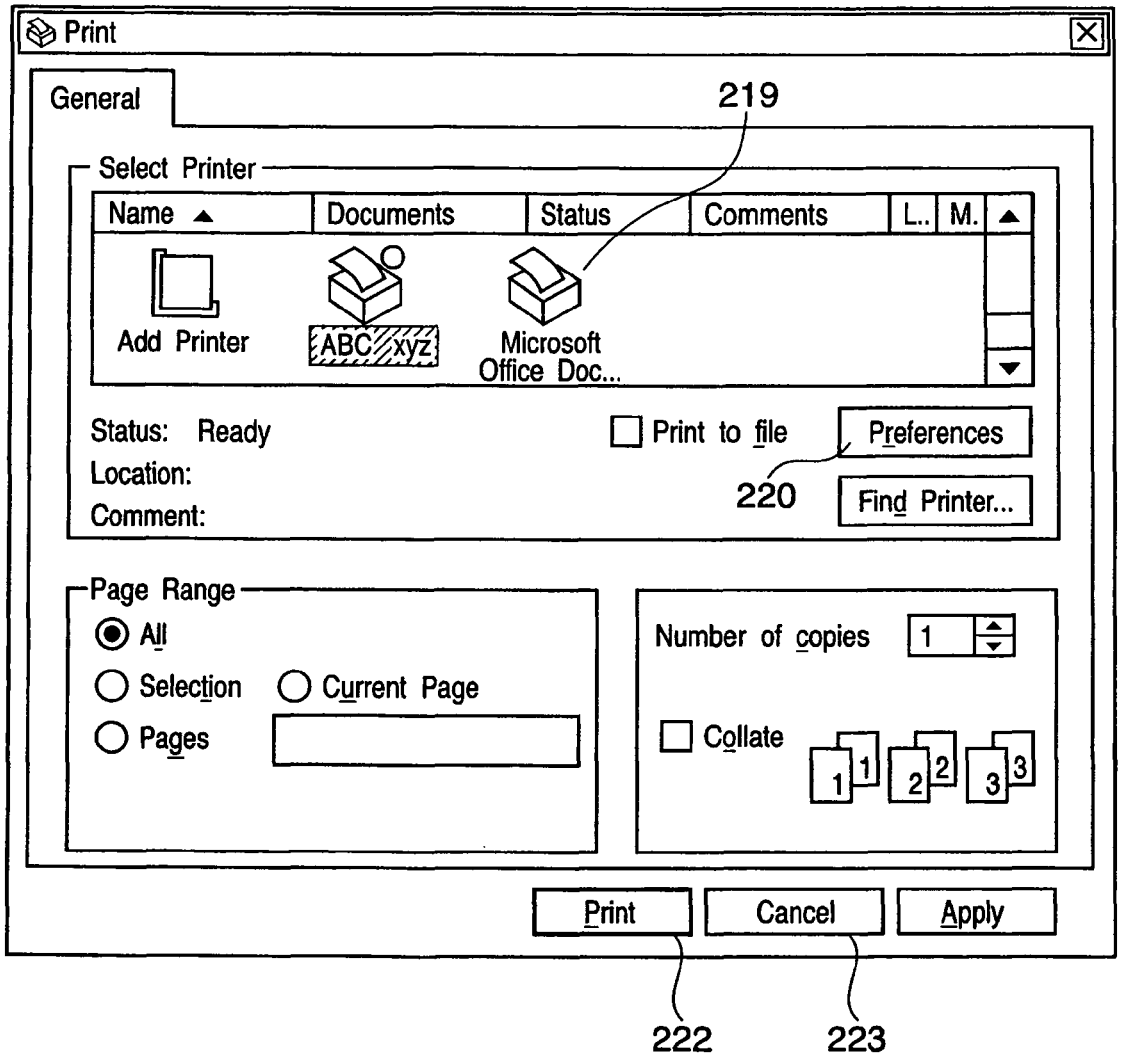
FIG. 6 is a view showing a display example of a Print dialog.

FIG. 6 is a view showing a display example of a Print dialog. When the print menu 217 is selected in FIG. 5, as described above, the Print dialog is displayed.

Reference numeral 219 denotes a printer selection area where icons representing printers capable of executing printing are displayed. By designating one of these icons, one printer which executes printing can be designated. In FIG. 6, the printer 3 (printer driver 50) is selected.

Reference numeral 220 denotes a Preferences button. When the Preferences button 220 is designated with the keyboard or mouse, the CPU 1204 detects this operation, and displays on the display screen of the display device 1205 a dialog for making detailed settings of a printer selection area 219 or those of a driver for the printer.

Reference numeral 222 denotes a Print button. When the Print button 222 is designated with the keyboard or mouse, the CPU 1204 detects this operation, starts printing at selected settings, and closes the Print dialog.

Reference numeral 223 denotes a Cancel button. When the Cancel button 223 is designated with the keyboard or mouse, the CPU 1204 detects this operation, and closes the Print dialog without starting printing.

Figure 7:
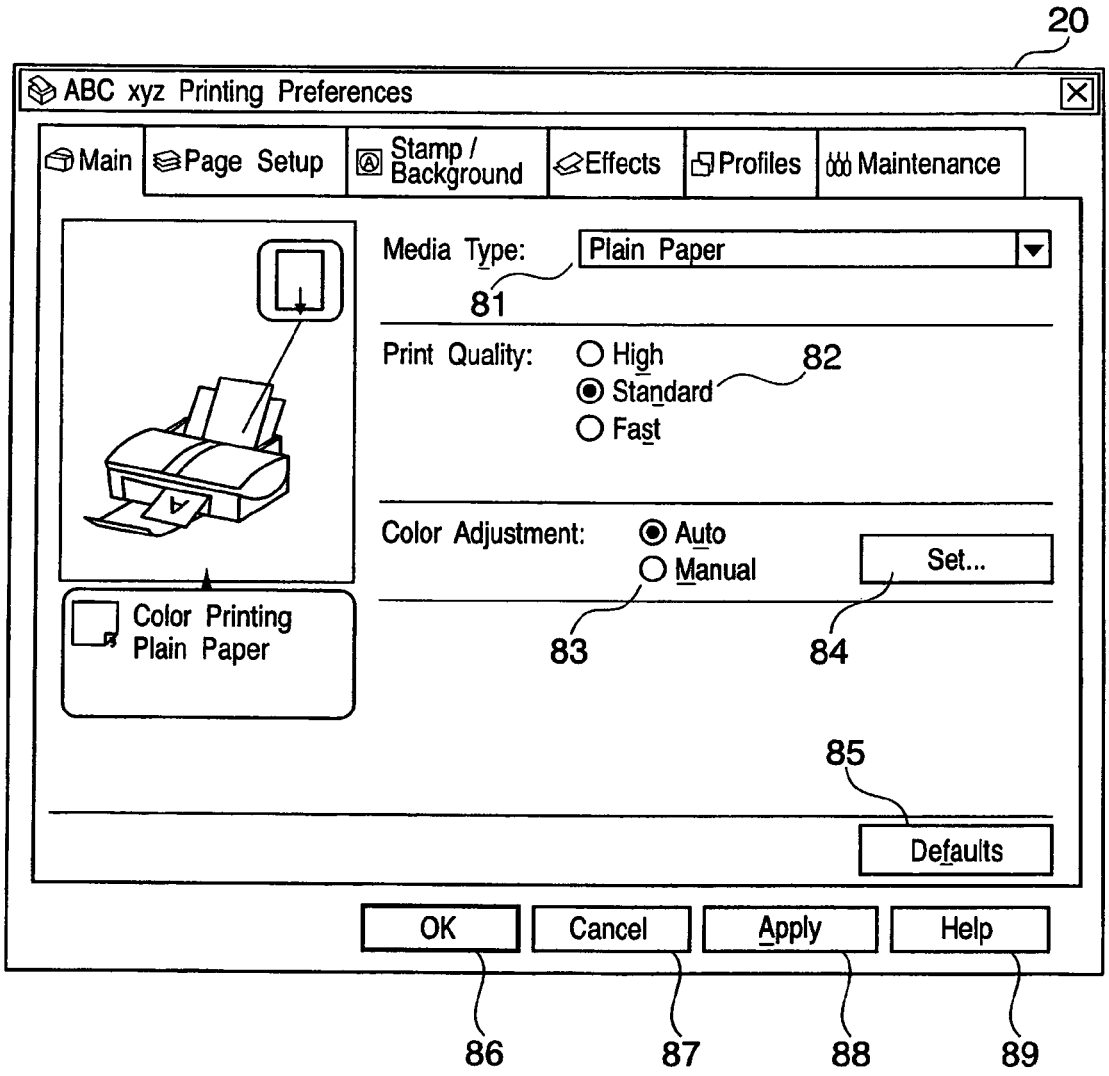
FIG. 7 is a view showing a display example of the Main sheet of a Preferences dialog provided by a UI module 35 of the printer driver 50.

FIG. 7 is a view showing a display example of the Main sheet of a Preferences dialog provided by the UI module 35 of the printer driver 50. In FIG. 7, reference numeral 20 denotes a Preferences dialog of the printer driver 50. In FIG. 6, while the printer model is selected in the printer selection area 219, the Preferences button 220 is designated. Then, the CPU 1204 detects this operation, activates the UI module of the printer driver 50, and displays the dialog shown in FIG. 7 while this sheet is selected.

Reference numeral 81 denotes a menu which is used to select the Media Type and allows selecting the Media Type from Plain Papers Hagaki (postcard), and Ink Jet Hagaki.

Reference numeral 82 denotes a radio button group for selecting the Print Quality. By designating a corresponding radio button, the Print Quality can be selected from High, Standard, and Fast.

Reference numeral 83 denotes a radio button group for selecting Color Adjustment. By selecting a corresponding radio button, the color in printing can be adjusted by Auto or Manual. When Manual is selected, a setting (Set . . . ) button 84 becomes valid. When the button 84 is designated, the CPU 1204 detects this operation, and displays a manual color adjustment dialog (not shown). Through this manual color adjustment dialog, the user can achieve adjustment of the color balance between cyan, magenta, yellow, and black, density adjustment, ICM ON/OFF operation, selection of the matching method (auto, photo, graphics, or none), and brightness adjustment (bright, normal, or dark).

Reference numeral 85 denotes a button (Defaults) for restoring settings to defaults. When this button is designated, the CPU 1204 detects this operation, initializes settings on the Main sheet, sets default values in print setting information, and updates and saves the settings.

Reference numeral 88 denotes an Apply button. When this button is designated, the CPU 1204 detects this operation, sets print setting information at this time, updates the settings, and saves them in a registry in the HDD 1202.

Reference numeral 89 denotes a Help button. When this button is designated, the CPU 1204 detects this operation, and displays the help menu of the printer driver 50.

Reference numeral 86 denotes an OK button. When this button is designated, the CPU 1204 detects this operation, sets print setting information at this time in a DEVMODE structure (to be described later with reference to FIG. 27) and a registry in the HDD 1202, and updates and saves the settings. After that, the CPU 1204 closes the Preferences dialog.

Reference numeral 87 denotes a Cancel button. When this button is designated, the CPU 1204 detects this operation, and closes the Preferences dialog without updating print setting information.

The DEVMODE structure is a structure (print setting registration information) used for a print process between the printer driver and an application for the Windows XP® OS. The DEVMODE structure is divided into a public area defined by the OS, and a private area which can be arbitrarily defined by the manufacturer of each printer driver, as needed. The DEVMODE structure is well known, and its usage is also well known. Only part of the DEVMODE structure that is associated with the embodiment will be described with reference to FIG. 27, and a detailed description of the DEVMODE structure will be omitted. The registry is a known area where a printer driver for the OS can save each print setting information. The usage of the registry is also well known, and a detailed description thereof will be omitted.

Figure 8:
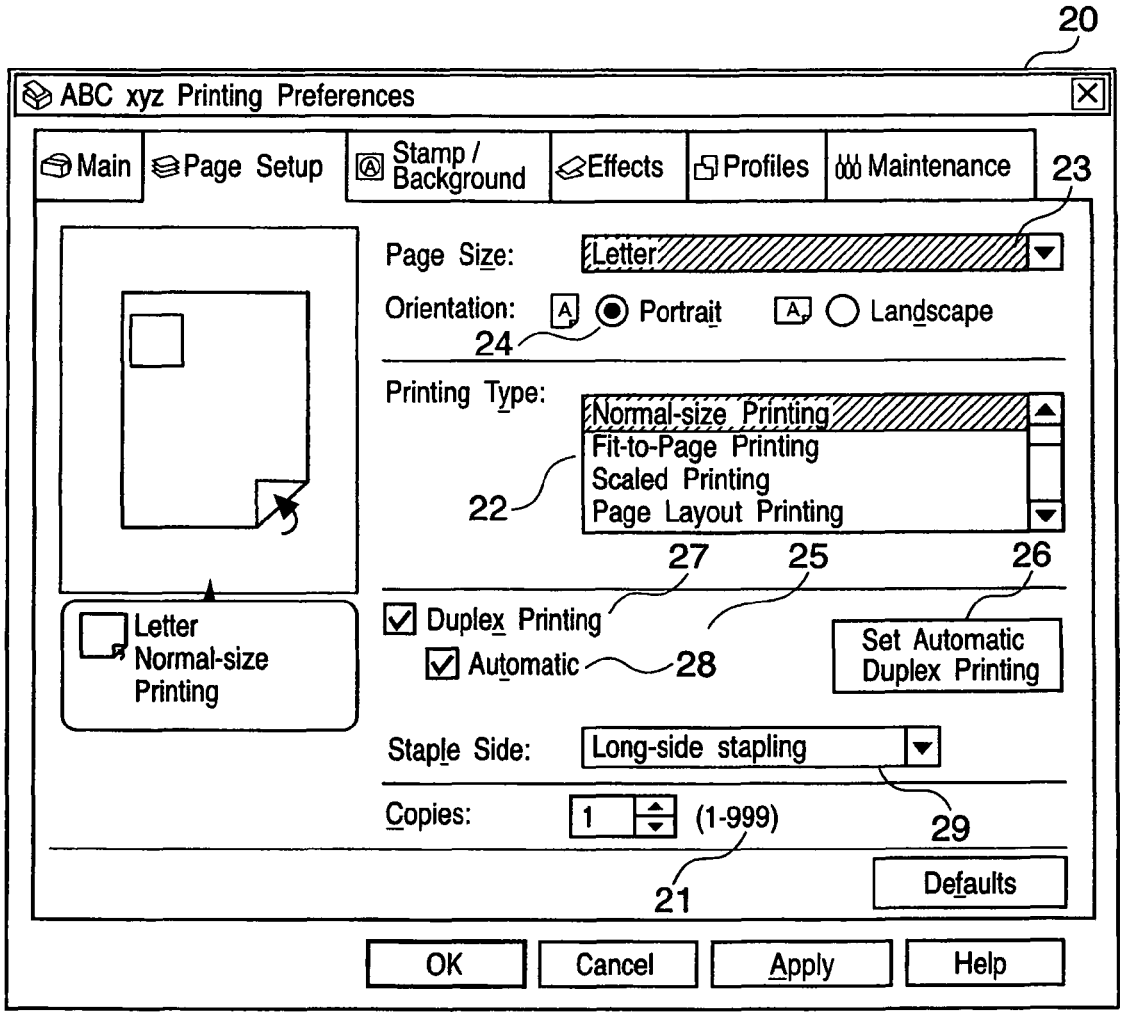
FIG. 8 is a view showing the Page Setup sheet of a Preferences dialog 20.

FIG. 8 is a view showing the Page Setup sheet of the Preferences dialog 20. If the Page Setup tab is selected while the Main sheet of the Preferences dialog 20 in FIG. 7 is displayed, the Page Setup sheet is displayed.

In FIG. 8, reference numeral 23 denotes a menu for selecting the Page Size. The menu 23 allows selecting the Page Size from A4, Letter, Hagaki (postcard) 100×148 mm, and the like.

Reference numeral 24 denotes a radio button group for selecting the Orientation. By designating a corresponding radio button, the Orientation can be selected from Portrait and Landscape.

Reference numeral 22 denotes an area for selecting the Printing Type. The area 22 allows selecting the Printing Type from Normal-size Printing, Fit-to-Page Printing, Scaled Printing, and Page Layout Printing.

Reference numeral 21 denotes a Copies designation field where the number of print copies can be designated within the range of 1 to 999 copies.

Reference numeral 25 denotes a duplex printing selection field which is made up of a Duplex Printing check box 27, Automatic check box 28, Staple Side selection menu 29, and Automatic Duplex Printing setting button 26. The duplex printing selection field 25 allows selecting manual or automatic duplex printing, and selecting detailed settings for duplex printing.

The Duplex Printing check box 27 is used to select the ON/OFF state of duplex printing. When this check box is checked, duplex printing is performed; when not checked, single-side printing is performed.

The Automatic check box 28 becomes valid when the Duplex Printing check box 27 is checked, and invalid (grayed out) when the Duplex Printing check box 27 is not checked. When both the Duplex Printing check box 27 and Automatic check box 28 are checked, the printer operates in the automatic duplex printing mode and executes automatic duplex printing. When the Duplex Printing check box 27 is checked but the Automatic check box 28 is not checked, the printer operates in the manual duplex printing mode and executes manual duplex printing.

In automatic duplex printing, when automatic duplex printing is performed while the automatic duplex unit 10 is mounted in the printer 3, the printer sequentially prints pages from the first page transmitted from the printer driver 50 in the order of 1, 2, 3, . . . . After an odd-numbered page corresponding to the front side of a paper sheet set in the ASF 11 is printed, the paper sheet is reversed in the automatic duplex unit 10 without discharging it onto the discharge tray 12. Then, an even-numbered page next to the odd-numbered page is printed on the back side of the paper sheet. After the even-numbered page is printed, the paper sheet is discharged onto the discharge tray 12. By this operation, duplex printing is executed. Note that mechanisms for reversal in the automatic duplex unit 10 and discharge of paper can be implemented using well-known mechanisms. These mechanisms are not features of the embodiment, and a detailed description thereof will be omitted.

In manual duplex printing, when manual duplex printing is set, the printer first prints odd-numbered pages from the first page transmitted from the printer driver 50 in the order of 1, 3, 5, . . . on the front sides of paper sheets set in the ASF 11. After each odd-numbered page is printed, the paper sheet is temporarily discharged onto the discharge tray 12. After all odd-numbered pages are printed, the print sheets which are discharged onto the discharge tray 12 and have undergone printing of all the odd-numbered pages are manually set in the ASF 11 by the user. Then, the printer prints even-numbered pages from the second page transmitted from the printer driver 50 in the order of 2, 4, 6, . . . on the back sides of the paper sheets set again in the ASF 11. After each even-numbered page is printed, the paper sheet is discharged onto the discharge tray 12.

The Staple Side selection menu 29 is used to select the staple side, and allows selecting the staple side from Long-side stapling and Short-side stapling.

The Automatic Duplex Printing setting button 26 is used to display an automatic duplex printing setting dialog for making detailed settings of automatic duplex printing. When this button is designated, the CPU 1204 detects this operation, and displays an automatic duplex printing setting dialog (to be described later with reference to FIG. 9) by using the UI module 35 of the printer driver 50.

Figure 9:
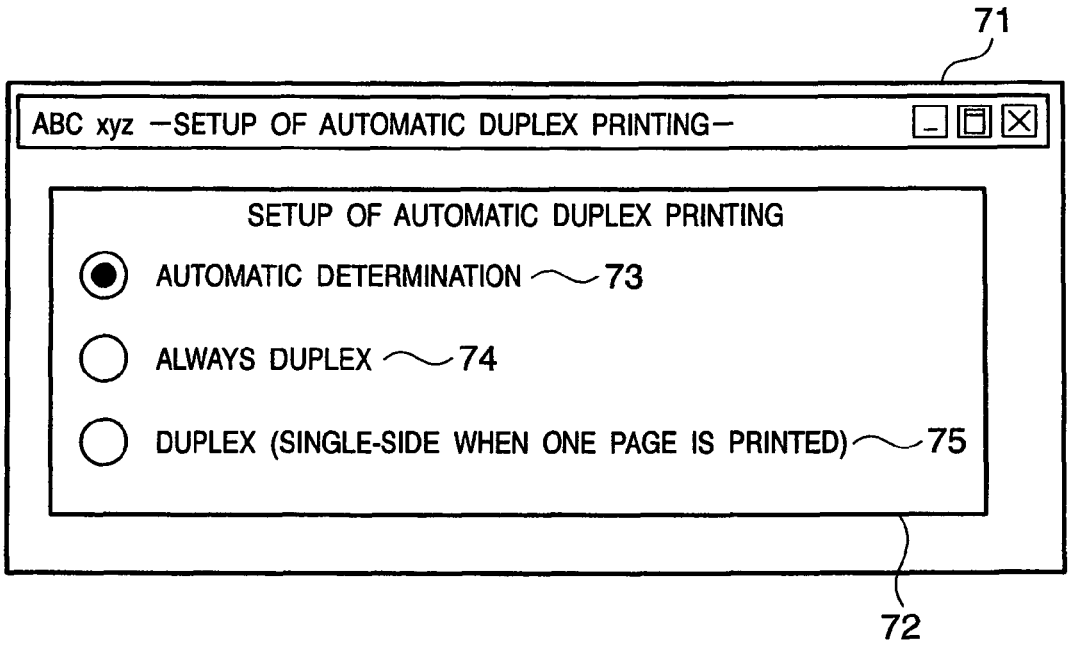
FIG. 9 is a view showing a display example of an automatic duplex printing setting dialog.

FIG. 9 is a view showing a display example of the automatic duplex printing setting dialog. In FIG. 9, reference numeral 71 denotes an automatic duplex printing setting dialog. By operating this dialog, detailed settings in automatic duplex printing can be made.

Reference numeral 72 denotes an automatic duplex printing setting operation field which is made up of an automatic determination radio button 73, "always duplex" radio button 74, and "duplex (single-side printing when one page is printed)" radio button 75. Only one of these three radio buttons can be selected.

When the "automatic determination" mode of the radio button 73 is selected, the printer driver 50 analyzes print image data, print setting information (page size, media type, print quality, etc.), and the like in a print job. The printer driver 50 determines whether the print job is treated as one of a series of print jobs in automatic duplex printing, or a print job in general single-side printing that is contained in a plurality of print jobs in automatic duplex printing. On the basis of the determination result, the printer driver 50 decides either automatic duplex printing or single-side printing as the print mode, and switches print control including the discharge method and image process.

When the "always duplex" mode of the radio button 74 is selected, the printer driver 50 assumes that a print job always corresponds to duplex printing, decides automatic duplex printing as the print mode, and executes print control including the discharge method and image process for automatic duplex printing.

When the "duplex (single-side when one page is printed)" mode of the radio button 75 is selected and a print job corresponds to 1-page printing, the printer driver 50 assumes single-side printing, decides single-side printing as the print mode, and executes print control including the discharge method and image process for single-side printing. When a print job corresponds to printing of two or more pages, the printer driver 50 assumes duplex printing, decides duplex printing as the print mode, and executes print control including the discharge method and image control for automatic duplex printing.

<DEVMODE Structure>

Figure 27:
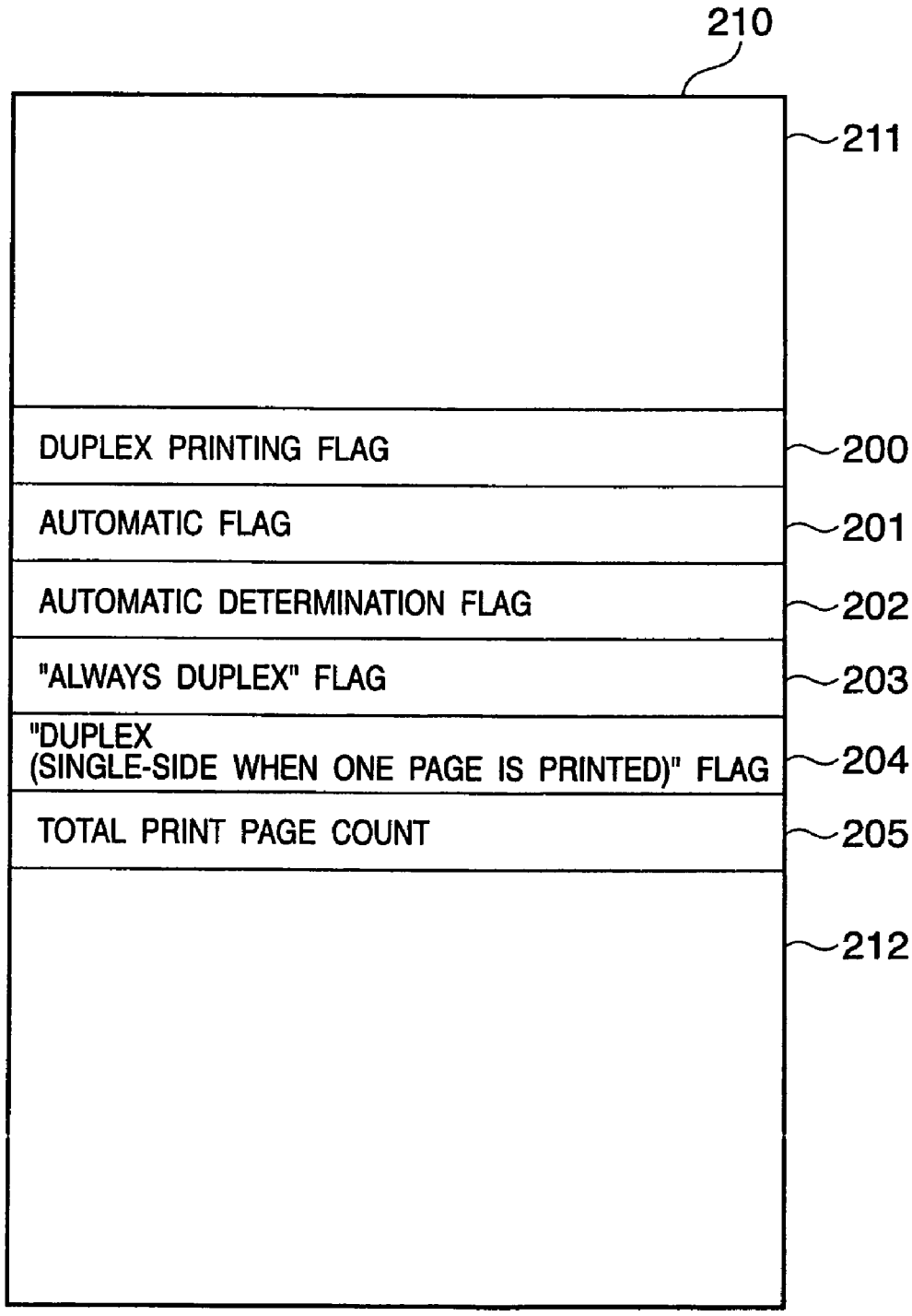
FIG. 27 is a view showing a DEVMODE structure.

FIG. 27 is a view showing the DEVMODE structure. In FIG. 27, reference numeral 210 denotes a DEVMODE structure which is formed from a public area 211 defined by the OS and a private area 212 defined by the printer driver 50.

The private area 212 contains members of a duplex printing flag 200, automatic flag 201, automatic determination flag 202, "always duplex" flag 203, "duplex (single-side when one page is printed)" flag 204, and total print page count 205.

The duplex printing flag 200 reflects the state of the Duplex Printing check box 27. The duplex printing flag 200 is set when the check box 27 is checked, and cleared when it is not checked.

The automatic flag 201 reflects the state of the Automatic check box 28. The automatic flag 201 is set when the check box 28 is checked, and cleared when it is not checked.

The automatic determination flag 202 reflects the state of the radio button 73. The automatic determination flag 202 is set when the radio button 73 is selected, and cleared when it is not selected.

The "always duplex" flag 203 reflects the state of the radio button 74. The "always duplex" flag 203 is set when the radio button 74 is selected, and cleared when it is not selected.

The "duplex (single-side when one page is printed)" flag 204 reflects the state of the radio button 75. The "duplex (single-side when one page is printed)" flag 204 is set when the radio button 75 is selected, and cleared when it is not selected.

The total print page count 205 sets the total number of print pages by a print job.

<Single-Side/Duplex Printing Control Command>

FIG. 10 is a view showing a single-side/duplex printing control command. The single-side/duplex printing control command is one of control commands which are generated by the printer driver 50 and sent from the PC 1 to the printer 3. The single-side/duplex printing control command controls single-side printing or duplex printing.

This command is made up of a command ID, print mode, page setup, rotation control, and discharge control.

The command ID is 0008 [HEX] representing that the command is a single-side/duplex printing control command.

In the print mode, one of 0010 [HEX] representing single-side printing (duplex printing: OFF), 0020 [HEX] representing manual duplex printing, and 0030 [HEX] representing automatic duplex printing is set.

In the page setup, when 0020 [HEX] representing manual duplex printing is set in the print mode, the number of pages to be reversed after set pages is set within the range of 0001 to FFFE [HEX]. When another print mode is set, the total number of print pages is set within the range of 0001 to FFFE [HEX], or FFFF [HEX] representing that the total number of print pages is unknown is set.

In rotation control, 0000 [HEX] representing default values (rotation axis of paper: no rotation, media type: not designated, and orientation: not designated) is set when 0010 [HEX] representing single-side printing (duplex printing: OFF) is set in the print mode. When another print mode is set, one of 0000 [HEX], 1000 [HEX], 2000 [HEX], and 3000 [HEX] for the rotation axis of paper, one of 0000 [HEX], 0100 [HEX], 0200 [HEX], and 0300 [HEX] for the media type, and one of 0000 [HEX], 0010 [HEX], and 0020 [HEX] for the orientation are added and set. As for the rotation axis of paper, 0000 [HEX] represents no rotation about the rotation axis of paper; 1000 [HEX], rotation about an axis perpendicular to the paper feed direction; 2000 [HEX], rotation about an axis parallel to the paper feed direction; and 3000 [HEX], rotation about an axis perpendicular to the paper surface. As for the media type, 0000 [HEX] represents that no media type is designated; 0100 [HEX], the vertical format; 0200 [HEX], the horizontal format; and 0300 [HEX], an aspect ratio of 1:1. As for the orientation, 0000 [HEX] represents that no orientation is designated; 0010 [HEX], the portrait; and 0020 [HEX], the landscape.

In discharge control, when 0030 [HEX] representing automatic duplex printing is set in the print mode, one of 0000 [HEX], 1000 [HEX], and 2000 [HEX] is set. As for discharge control, 0000 [HEX] represents execution of control under which nothing is done in the printer; 1000 [HEX], execution of control under which, when odd-numbered pages are printed, the final page is automatically discharged via the automatic duplex unit in the printer; and 2000 [HEX], execution of control under which, when three or more odd-numbered pages are printed, the final page is automatically discharged via the automatic duplex unit. When another print mode is set, a default value 0000 [HEX] representing execution of control under which nothing is done in the printer is set.

When the printer 3 receives the single-side/duplex printing control command, it performs print control in accordance with the above contents.

<Print Pulse Control Command>

FIG. 11 is a view showing a print pulse control command. The print pulse control command is one of control commands which are generated by the printer driver 50 and sent from the PC 1 to the printer 3. The print pulse control command controls a print pulse generated by the printing unit 19. This command is formed from a command ID, color, data length, and print pulse data.

The command ID takes 000A [HEX] representing that the current command is a print pulse control command. In the color, one of 0010 [HEX] representing cyan, 0020 [HEX] representing magenta, 0030 [HEX] representing yellow, and 0040 [HEX] representing black is set. In the data length, the length (number of bytes) of print pulse data is designated (set) within the range of 0000 to FFFF [HEX]. As the print pulse data, print pulse data formed from the number of bytes designated by the data length is set. The print pulse data is binary data. The bit of a portion (pixel) at which a print pulse is generated is set (value=1), and the bit of a portion (pixel) at which no print pulse is generated is cleared (value=0).

When the printer 3 receives the print pulse control command and print pulse data is set (value=1), the printing unit 19 generates a print pulse to print on a print sheet. When print pulse data is cleared (value=0), the printing unit 19 neither generates any print pulse nor prints on a print sheet.

<Page Control Command>

FIG. 12 is a view showing a page control command. The page control command is one of control commands which are generated by the printer driver 50 and sent from the PC 1 to the printer 3. The page control command transmits, to the printer 3, information on a page during printing. This command is formed from a command ID, page number, the total number of pages, and start/end.

The command ID takes 000C [HEX] representing that the current command is a page control command. In the page number, the page number during printing is set within the range of 0001to FFFE [HEX]. The total number of pages is set within the range of 0001to FFFE [HEX], or FFFF [HEX] representing that the total number of print pages is unknown is set. This command is sent from the PC 1 to the printer 3 at the start and end of a page. In accordance with the start or end, either of 0000 [HEX] representing the start of a page and 0001 [HEX] representing the end of the page is set. When the printer 3 receives the page control command, it performs print control in accordance with information represented by the contents of the command, i.e., information on a page during printing.

<Example of Creating Each Command>

FIG. 13 is a view showing an example of a control command for single-side printing. When single-side printing is done for a total of five print pages at print settings as shown in FIG. 13, a single-side/duplex printing control command represented by the control command is sent from the PC 1 to the printer 3. More specifically, the single-side/duplex printing control command "0008" in the command ID, single-side printing "0010" in the print mode, and the total print page count "0005" in the page setup are designated as the control command.

FIG. 14 is a view showing an example of a control command for manual duplex printing. When manual duplex printing is done for a total of five print pages in print settings as shown in FIG. 14, a single-side/duplex printing control command represented by the control command is sent from the PC 1 to the printer 3. More specifically, the single-side/duplex printing control command "0008" in the command ID, manual duplex printing "0020" in the print mode, the page number "0003" subjected to reversal by the user in the page setup, and "2110 (rotation along an axis parallel to the paper feed direction, paper of the vertical format, and the portrait orientation)" representing the rotation axis of paper, the media type, and the orientation are designated as the control command.

FIG. 15 is a view showing an example of a control command for automatic duplex printing. When automatic duplex printing is done for a total of five print pages in print settings as shown in FIG. 15, a single-side/duplex printing control command represented by the control command is sent from the PC 1 to the printer 3. More specifically, the single-side/duplex printing control command "0008" in the-command ID, duplex printing "0030" in the print mode, the total print page count "0005" in the page setup, "2110 (rotation along an axis parallel to the paper feed direction, paper of the vertical format, and the portrait orientation)" representing the rotation axis of paper, the media type, and the orientation, and "2000" for "automatically discharging the final page via the automatic duplex unit in the printer when three or more odd-numbered pages are printed" are designated as the control command.

<Print Mode Control Table>

FIG. 16 is a table showing an example of the structure of a print mode control table which is referred to by the printer driver 50 in order to decide a print mode using print image data or print settings in a print job when automatic duplex printing and the automatic determination 73 are selected. Data in the table of FIG. 16 are contained in the printer driver 50. By referring to a table as shown in FIG. 16, either of single-side printing and automatic duplex printing can be decided as the print mode from a combination of print image data (a color image or monochrome text), and print settings (a page size selected in the Page Size selection field 23, a media type selected in the Media Type selection field 81, a print quality selected in the Print Quality selection field 82).

For example, attention is given to row No. 1. When print image data is a color image, the page size is Letter, the media type is plain paper, and the print quality is high, the print mode is single-side printing. This print mode is decided on the basis of the result of a research: when automatic duplex printing is selected and print image data is a color image, printing on plain paper at the page size: Letter and the print quality: high corresponds to single-side printing in many cases. That is, it is automatically determined that the current print job is a print job in general single-side printing that is contained in a plurality of print jobs in automatic duplex printing.

Attention is given to row No. 3. When print image data is a color image, the page size is Letter, the media type is plain paper, and the print quality is fast, the print mode is automatic duplex printing. This print mode is decided on the basis of the result of a research: when automatic duplex printing is selected and print image data is a color image, printing on plain paper at the page size: Letter and the print quality: fast corresponds to automatic duplex printing in many cases. That is, it is automatically determined that the current print job is one of a series of print jobs in automatic duplex printing.

Attention is given to row No. 10. When print image data is a monochrome text, the page size is A4, the media type is plain paper, and the print quality is high, the print mode is single-side printing. This print mode is decided on the basis of the result of a research: when automatic duplex printing is selected and print image data is a monochrome text, printing on plain paper at the page size: A4 and the print quality: high corresponds to single-side printing in many cases. That is, it is automatically determined that the current print job is a print job in general single-side printing that is contained in a plurality of print jobs in automatic duplex printing.

Further, attention is given to row No. 11. When print image data is a monochrome text, the page size is A4, the media type is plain paper, and the print quality is standard, the print mode is automatic duplex printing. This print mode is decided on the basis of the result of a research: when automatic duplex printing is selected and print image data is a monochrome text, printing on plain paper at the page size: A4 and the print quality: standard corresponds to automatic duplex printing in many cases. That is, it is automatically determined that the current print job is one of a series of print jobs in automatic duplex printing.

Attention is given to row No. 13. When print image data is a color image, the page size is Hagaki (postcard) 100×148 mm, the media type is Hagaki, and the print quality is high, the print mode is automatic duplex printing. This print mode is decided on the basis of the result of a research: when automatic duplex printing is selected and print image data is a color image, printing on Hagaki at the page size: Hagaki 100×148 mm and the print quality: high corresponds to automatic duplex printing in many cases. That is, it is automatically determined that the current print job is one of a series of print jobs in automatic duplex printing.

Also, attention is given to row No. 17. When print image data is a monochrome text, the page size is Hagaki (postcard) 100×148 mm, the media type is Hagaki, and the print quality is standard, the print mode is automatic duplex printing. This print mode is decided on the basis of the result of a research: when automatic duplex printing is selected and print image data is a monochrome text, printing on Hagaki at the page size: Hagaki 100×148 mm and the print quality: standard corresponds to automatic duplex printing in many cases. That is, it is automatically determined that the current print job is one of a series of print jobs in automatic duplex printing.

Attention is given to row No. 21. When print image data is a color image, the page size is Hagaki (postcard) 100×148 mm, the media type is Ink Jet Hagaki, and the print quality is fast, the print mode is automatic duplex printing. This print mode is decided on the basis of the result of a research: when automatic duplex printing is selected and print image data is a color image, printing on Ink Jet Hagaki at the page size: Hagaki 100×148 mm and the print quality: fast corresponds to automatic duplex printing in many cases. That is, it is automatically determined that the current print job is one of a series of print jobs in automatic duplex printing.

Then, attention is given to row No. 22. When print image data is a monochrome text, the page size is Hagaki (postcard) 100×148 mm, the media type is Ink Jet Hagaki, and the print quality is high, the print mode is automatic duplex printing. This print mode is decided on the basis of the result of a research: when automatic duplex printing is selected and print image data is a monochrome text, printing on Ink Jet Hagaki at the page size: Hagaki 100×148 mm and the print quality: high corresponds to automatic duplex printing in many cases. That is, it is automatically determined that the current print job is one of a series of print jobs in automatic duplex printing.

The table is created on the basis of the following features of the print system using a color ink-jet printer in addition to the above research results:

- In general, when a color ink-jet printer prints, setoff of ink applied to the front side more readily occurs as the print quality is higher.
- When the media type is relatively thin plain paper, print image data is a color image, and the print quality is high or standard, duplex printing is not suitable because setoff occurs at high possibility.
- When the media type is relatively thin plain paper, print image data is a monochrome text, and the print quality is high, duplex printing is not suitable because setoff occurs at high possibility.
- When the media type is relatively thick Hagaki (postcard) or Ink Jet Hagaki, duplex printing is suitable for most cases because setoff hardly occurs regardless of print image data.

Note that print image data is analyzed by the graphics driver 34. More specifically, the graphics driver 34 analyzes print image data in a print job, and identifies whether the print image data is a color image, monochrome text, or blank data (no print image data).

In the embodiment, print image data is identified in the above-mentioned range. Print image data may also be analyzed in more detail. For example, the print mode may be decided by identifying print image data in a wider range: the color and shape of an image, whether print image data contains a text, or whether print image data is a photograph, a graph, a table, a monochrome text, a color text, a monochrome line art, a grayscale image, or a composition of them. These are merely examples, and print image data and print settings are not limited to these examples. A print mode can be decided from a combination of arbitrary pieces of information which influence the print mode. Note that how to use the table in actual automatic duplex printing will be described in detail with reference to FIG. 31.

<Operation of Printer Driver 50>

Figure 17:
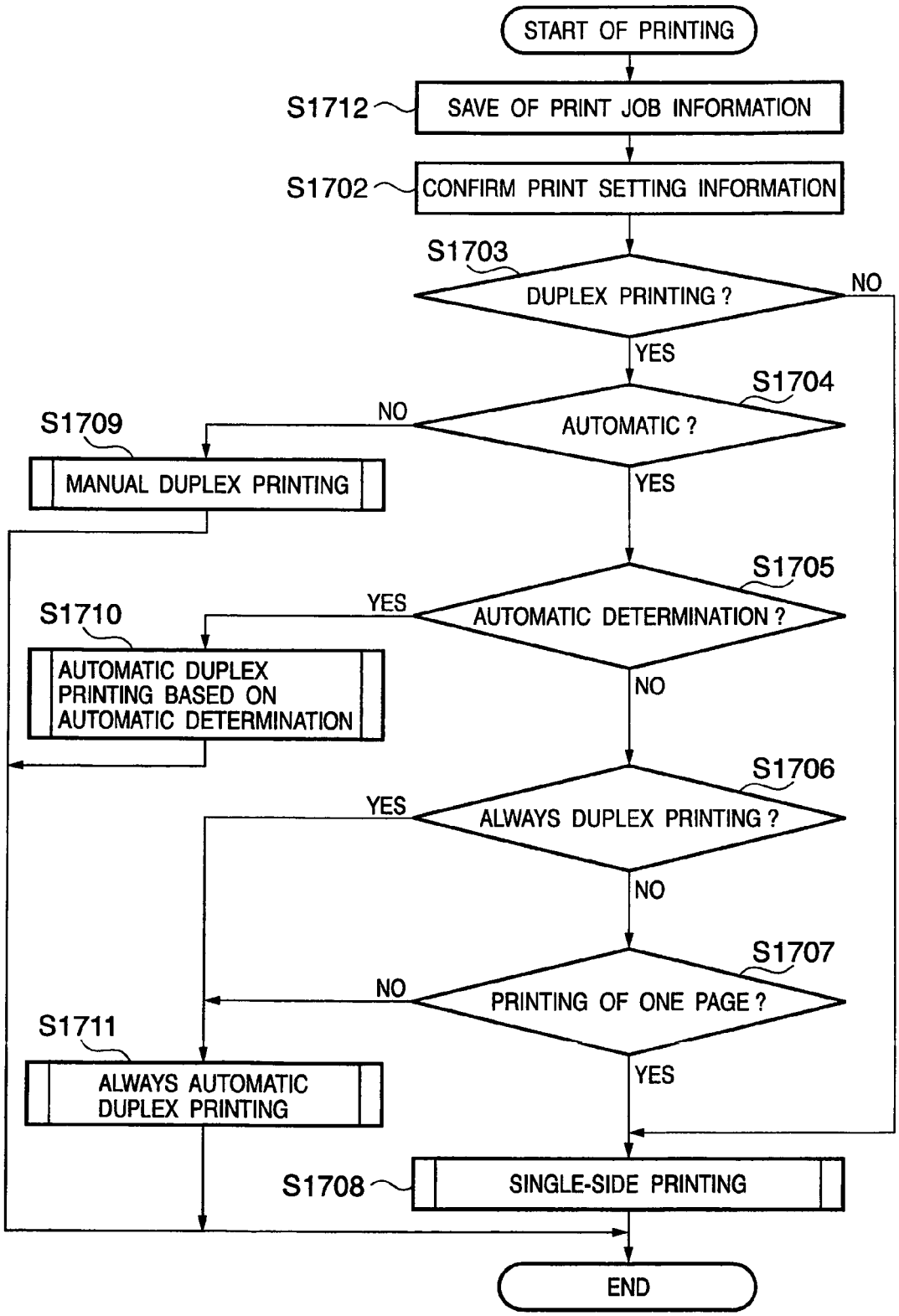
FIG. 17 is a flowchart showing a process performed when a CPU 1204 executes the printer driver 50.

A process performed when the CPU 1204 executes the printer driver 50 will be explained with reference to FIG. 17 showing the flowchart of the process.

The operator designates the Print button 222 on the Print dialog in FIG. 6 by using the keyboard or mouse. The CPU 1204 detects this operation, and executes the printer driver 50. A print job information save process (to be described later with reference to FIG. 30) is performed (step S1712). The printer driver 50 refers to the DEVMODE structure 210 (print setting information) in the print job (step S1702), and checks whether the duplex printing flag 200 is cleared (whether the Duplex Printing check box 27 is checked) (step S1703). If the duplex printing flag 200 is cleared (the Duplex Printing check box 27 is not checked), the process advances to step S1708 to perform a process so as to cause the printer 3 to execute a single-side printing process (step S1708). Details of the process in step S1708 will be described later with reference to FIG. 18. Thereafter, the printing process ends.

If the duplex printing flag 200 is set (Duplex Printing check box 27 is checked) in step S1703, the process advances to step S1704. The printer driver 50 checks whether the automatic flag 201 is cleared (whether the Automatic check box 28 is checked) (step S1704). If the automatic flag 201 is cleared (the Automatic check box 28 is not checked), the process advances to step S1709 to perform a process so as to cause the printer 3 to execute a manual duplex printing process (step S1709). Details of the process in step S1709 will be described later with reference to FIG. 19. After that, the printing process ends.

If the automatic flag 201 is set (the Automatic check box 28 is checked) in step S1704, the process advances to step S1705. The printer driver 50 checks whether the automatic determination flag 202 is set (whether the automatic determination radio button 73 is selected) (step S1705). If the automatic determination flag 202 is set (the automatic determination radio button 73 is selected), the process advances to step S1710 to perform a process so as to cause the printer 3 to execute an automatic duplex printing process based on automatic determination (step S1710). Details of the process in step S1710 will be described later with reference to FIG. 31. After that, the printing process ends.

If the automatic determination flag 202 is cleared (the automatic determination radio button 73 is not selected) in step S1705, the process advances to step S1706. The printer driver 50 checks whether the "always duplex" flag 203 is set (whether the "always duplex" radio button 74 is selected) (step S1706). If the "always duplex" flag 203 is set (the "always duplex" radio button 74 is selected), the process advances to step S1711 to perform a process so as to cause the printer 3 to always execute a duplex printing process (step S1711). Details of the process in step S1711 will be described later with reference to FIG. 20. Then, the printing process ends.

If the "always duplex" flag 203 is cleared (the "always duplex" radio button 74 is not selected) in step S1706, this means that the "duplex (single-side when one page is printed)" flag 204 is set (the radio button 75 is selected). The process advances to step S1707. The printer driver 50 analyzes print data which is stored in the printer queue 32 from the application 30 via the GDI 31, and checks whether the total print page count 205 represents one page (step S1707). If the total print page count 205 represents one page, the process advances to step S1708. If the total print page count 205 represents a plurality of pages, the process advances to step S1711.

Figure 30:
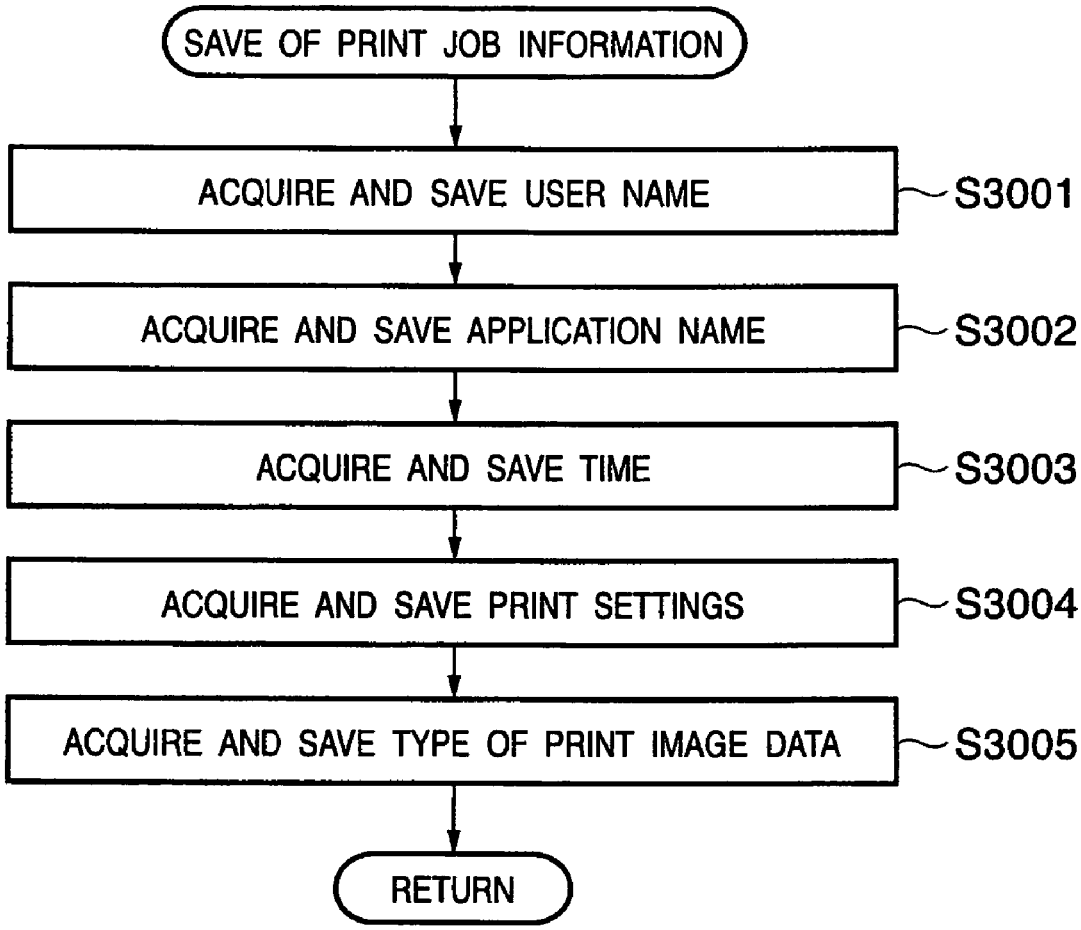
FIG. 30 is a flowchart showing details of a process in step S1712.

FIG. 30 is a flowchart showing details of the process in step S1712. The printer driver 50 acquires the user name of a print job from the print job which is transferred from the GDI 31, and saves the user name in a predetermined key of the registry in the HDD 1202 (step S3001). The printer driver 50 acquires an application name from the print job, and saves it in a predetermined key of the registry in the HDD 1202 (step S3002). The printer driver 50 acquires the current time including the year, month, and day from the OS, and saves it in a predetermined key of the registry in the HDD 1202 (step S3003). The printer driver 50 acquires print settings from the print job, and saves them in a predetermined key of the registry in the HDD 1202 (step S3004). The printer driver 50 acquires the type of print image data from the print job, and saves it in a predetermined key of the registry in the HDD 1202 (step S3005). Thereafter, the flow returns to the flowchart of FIG. 17. Note that information saved in a predetermined key of the registry in the HDD 1202 is kept saved in the HDD 1202 even if the OS is reactivated or shut down or the PC 1 is turned off.

In the embodiment, if it is determined in step S1705 that the automatic determination radio button 73 in FIG. 9 is selected, automatic duplex printing based on automatic determination in step S1710 is executed.

However, it is also possible to invalidate the Automatic setting 28 in FIG. 8, and omit the processes in steps S1704 and S1705. In this case, if YES in step S1703, the flow advances to step S1710 to execute automatic duplex printing based on automatic determination.

It is also possible to invalidate the Automatic Duplex Printing setting button 26 in FIG. 8, and omit the process in step S1705. In this case, if YES in step S1704, the flow advances to step S1710 to execute automatic duplex printing based on automatic determination.

Figure 18:
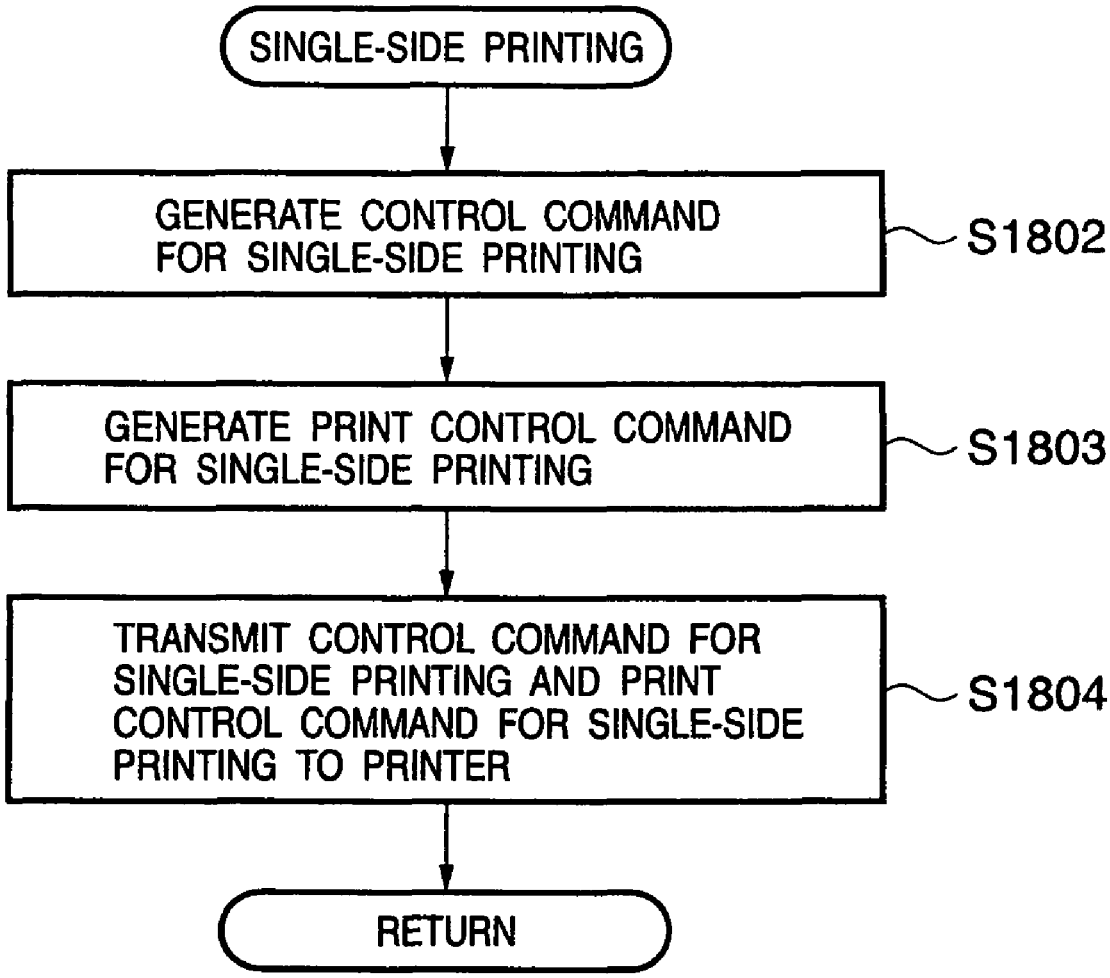
FIG. 18 is a flowchart showing details of a process in step S1708.

FIG. 18 is a flowchart showing details of the process in step S1708. The printer driver 50 generates a control command for single-side printing as shown in FIG. 13 by using the single-side/duplex printing control command shown in FIG. 10 (step S1802). The printer driver 50 generates a print control command for single-side printing by using the print pulse control command shown in FIG. 11 and the page control command shown in FIG. 12 (S1803). The printer driver 50 transmits the control command for single-side printing and the print control command for single-side printing to the printer 3 via the NB 1207 (step S1804). Then, the flow returns to the flowchart of FIG. 17.

Figure 19:
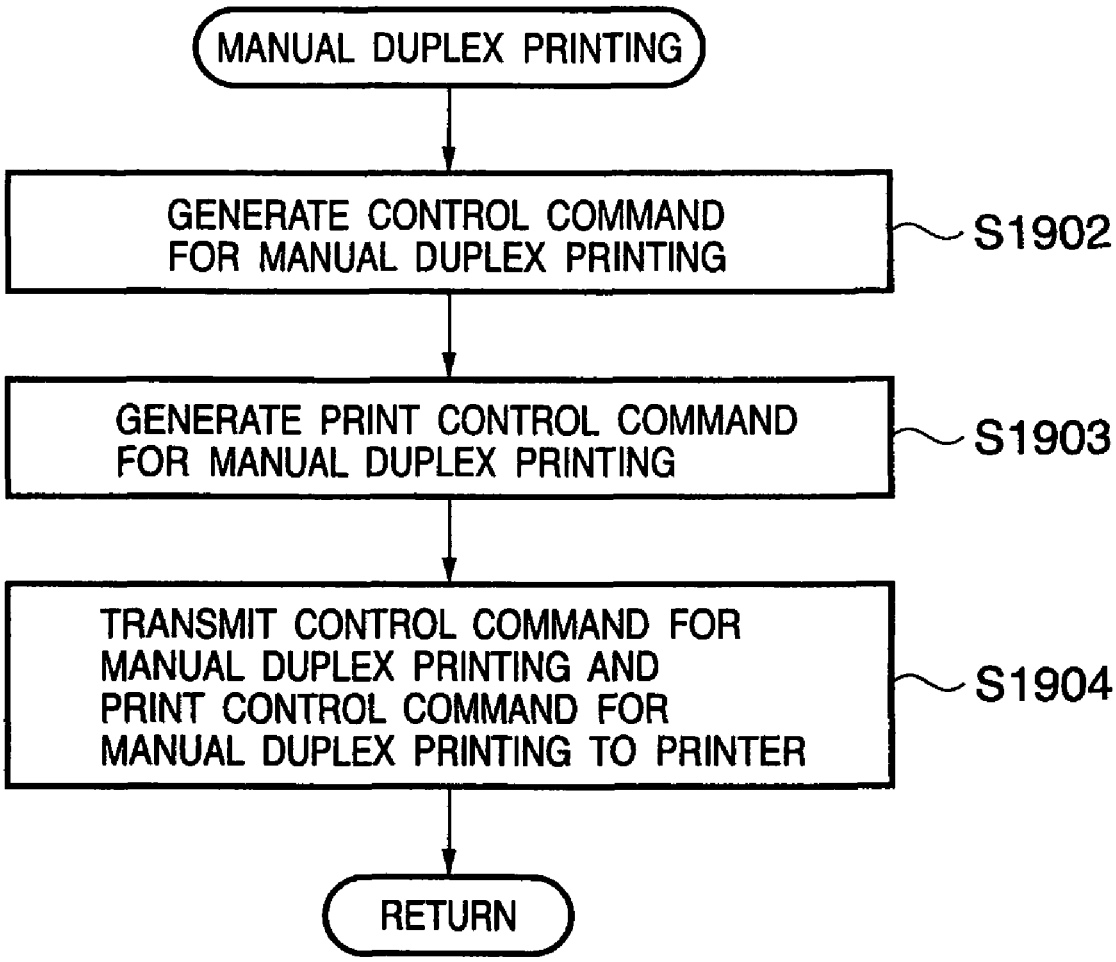
FIG. 19 is a flowchart showing details of a process in step S1709.

FIG. 19 is a flowchart showing details of the process in step S1709. The printer driver 50 generates a control command for manual duplex printing as shown in FIG. 14 by using the single-side/duplex printing control command shown in FIG. 10 (step S1902). The printer driver 50 generates a print control command for manual duplex printing by using the print pulse control command shown in FIG. 11 and the page control command shown in FIG. 12 (step S1903). The printer driver 50 transmits the control command for manual duplex printing and the print control command for manual duplex printing to the printer 3 via the NB 1207 (step S1904). Then, the flow returns to the flowchart of FIG. 17.

Figure 20:
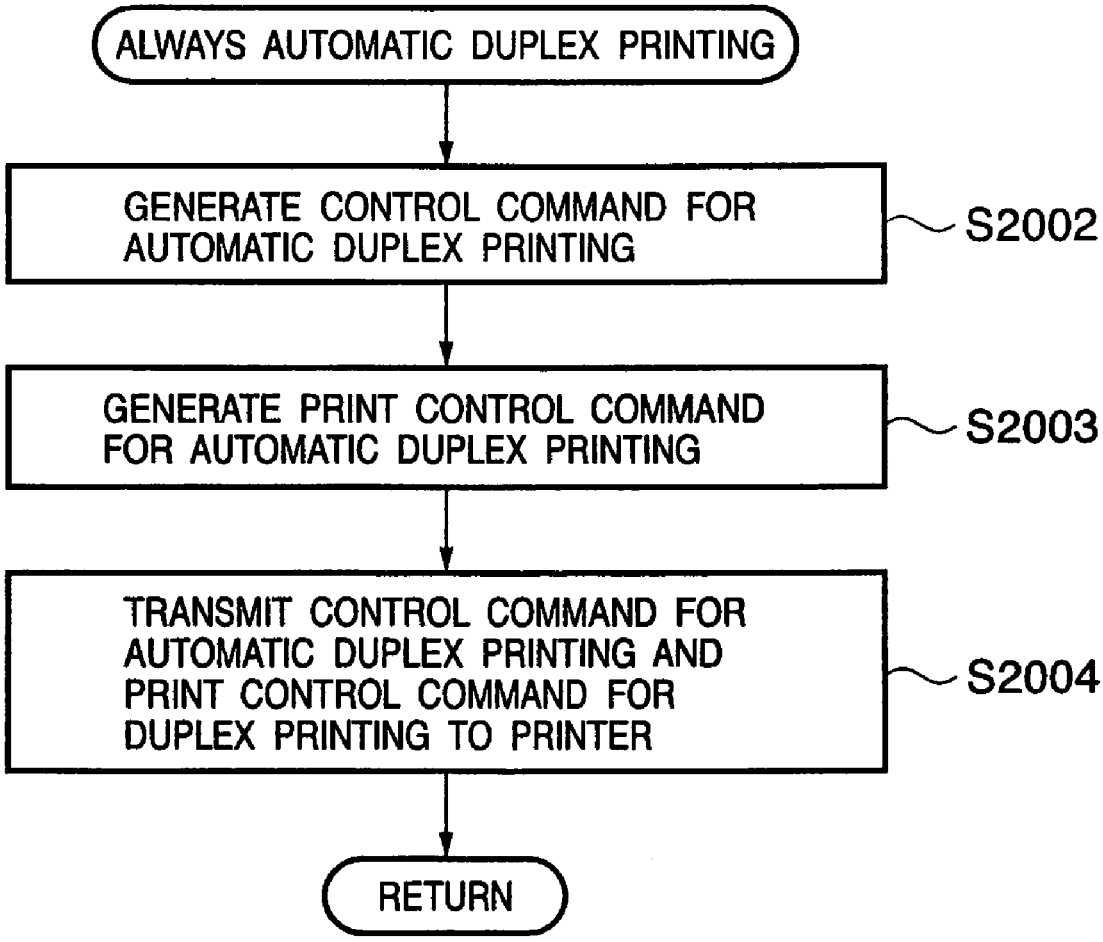
FIG. 20 is a flowchart showing details of a process in step S1711.

FIG. 20 is a flowchart showing details of the process in step S1711. The printer driver 50 generates a control command for automatic duplex printing as shown in FIG. 15 by using the single-side/duplex printing control command shown in FIG. 10 (step S2002). The printer driver 50 generates a print control command for automatic duplex printing by using the print pulse control command shown in FIG. 11 and the page control command shown in FIG. 12 (step S2003). The printer driver 50 transmits the control command for automatic duplex printing and the print control command for automatic duplex printing to the printer 3 via the NB 1207 (step S2004). Then, the flow returns to the flowchart of FIG. 17.

Figure 31:
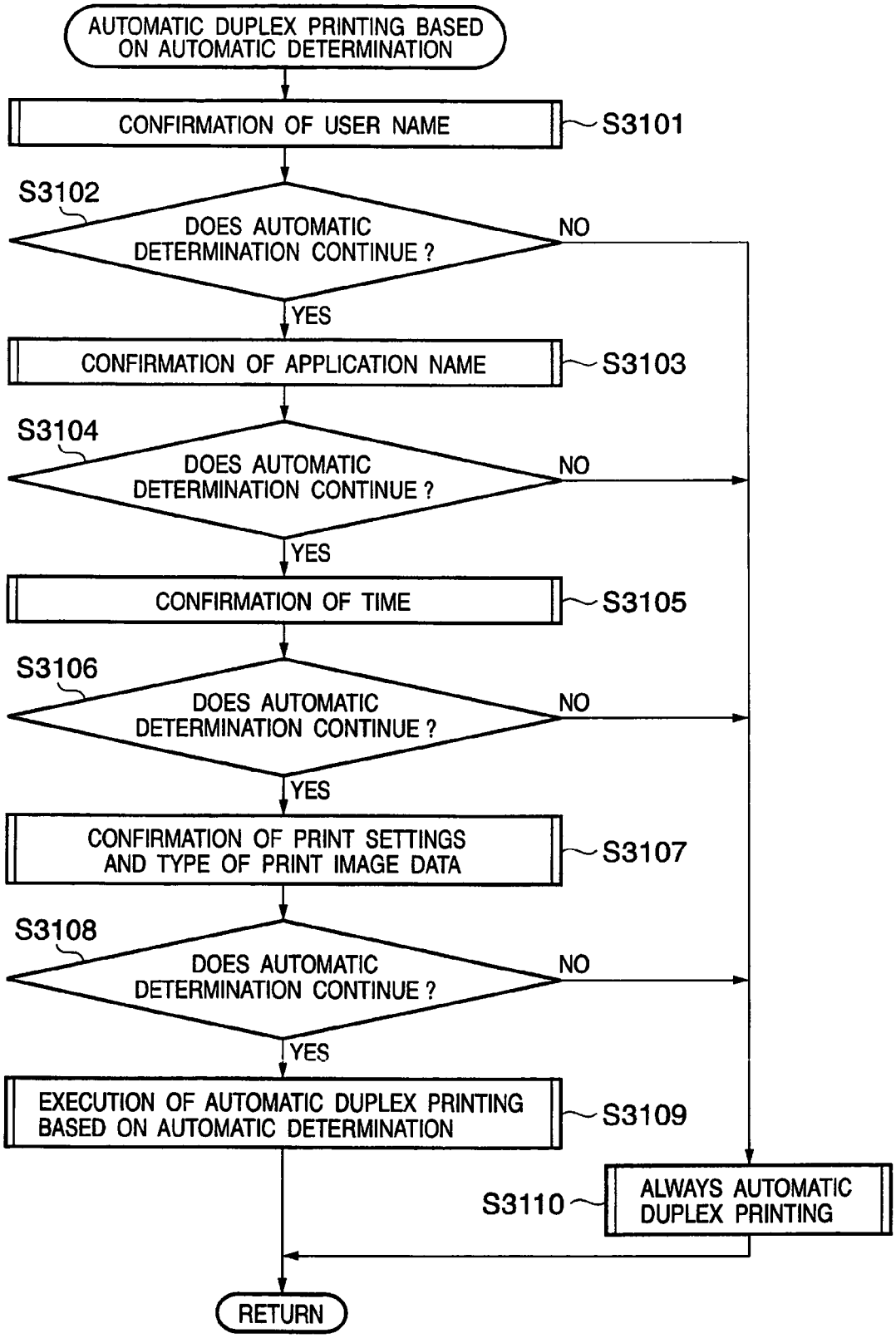
FIG. 31 is a flowchart showing details of a process in step S1710.

FIG. 31 is a flowchart showing details of the process in step S1710. The printer driver 50 performs a user name confirmation process (to be described later with reference to FIG. 32) (step S3101). If automatic determination continues (step S3102), the printer driver 50 performs an application name confirmation process (to be described later with reference to FIG. 33) (step S3103). If automatic determination continues (step S3104), the printer driver 50 performs a time confirmation process (to be described later with reference to FIG. 34)

(step S3105). If automatic determination continues (step S3106), the printer driver 50 performs a confirmation process for print settings and the type of print image data (to be described later with reference to FIG. 35) (step S3107). If automatic determination continues (step S3108), the printer driver 50 performs an automatic duplex printing execution process based on automatic determination (to be described later with reference to FIG. 21) (step S3109). Then, the flow returns to the flowchart of FIG. 17. If automatic determination does not continue in step S3108, the printer driver 50 always performs an automatic duplex printing process shown in FIG. 20 (step S3110). Then, the flow returns to the flowchart of FIG. 17. If automatic determination does not continue in step S3106, the flow advances to step S3110. If automatic determination does not continue in step S3104, the flow advances to step S3110. If automatic determination does not continue in step S3102, the flow advances to step S3110.

Figure 32:
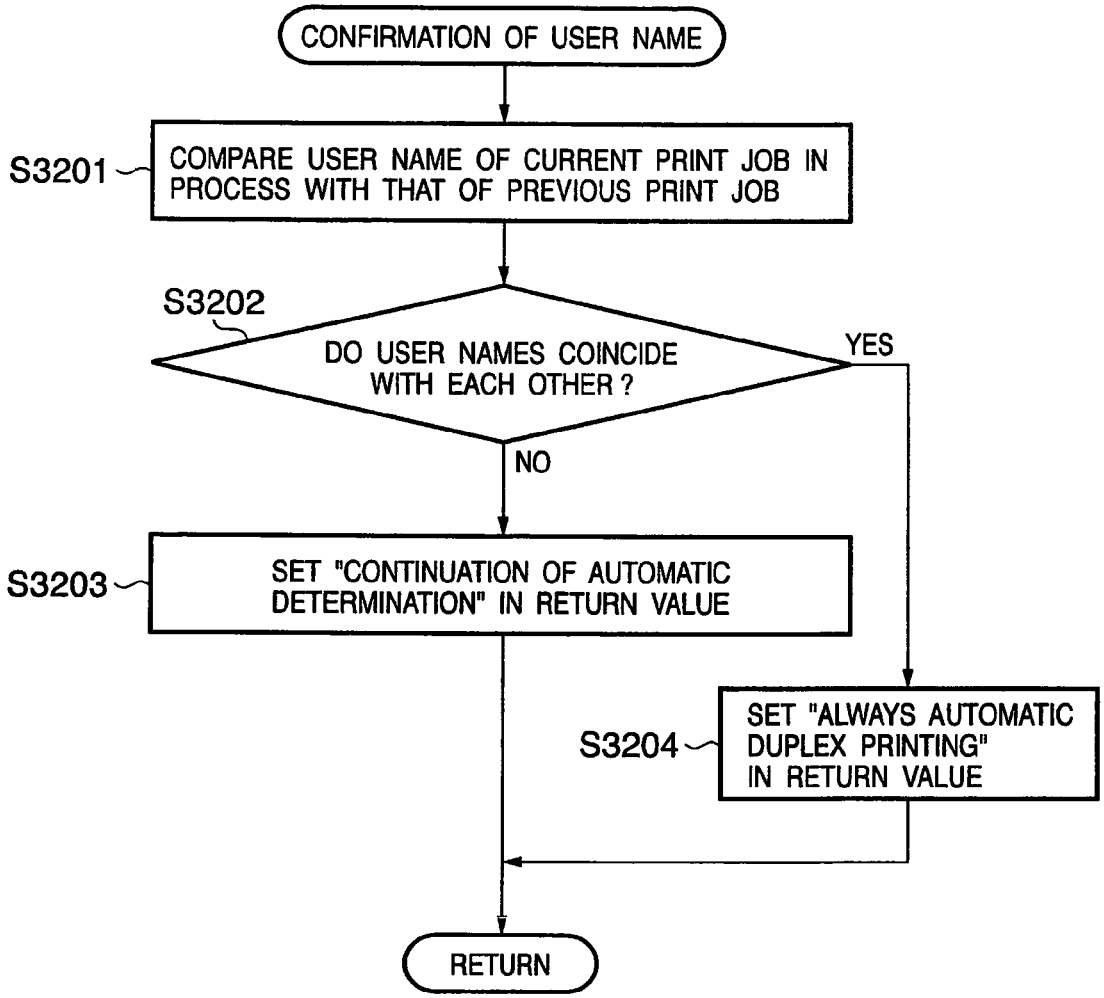
FIG. 32 is a flowchart showing details of a process in step S3101.

FIG. 32 is a flowchart showing details of the process in step S3101. The printer driver 50 compares the user name of the current print job in process with the user name of a previous print job that has been saved in step S3001 of FIG. 30 (step S3201). If these user names do not coincide with each other (NO in step S3202), the printer driver 50 sets "continuation of automatic determination" in the return value (step S3203), and the flow returns to the flowchart of FIG. 31. If these user names coincide with each other (YES in step S3202), the printer driver 50 sets "always automatic duplex printing" in the return value (step S3204), and the flow returns to the flowchart of FIG. 31.

Figure 33:
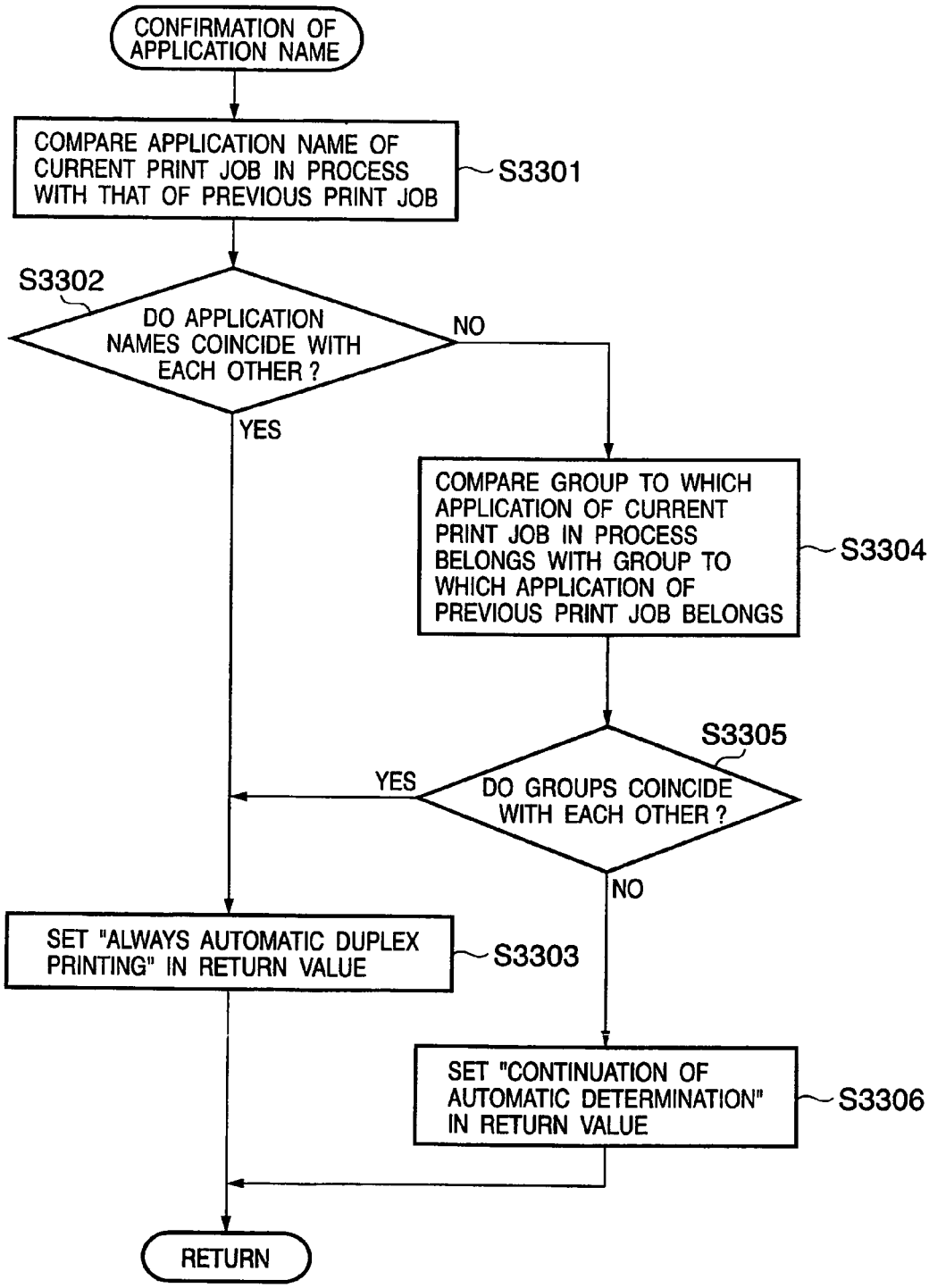
FIG. 33 is a flowchart showing details of a process in step S3103.

FIG. 33 is a flowchart showing details of the process in step S3103. The printer driver 50 compares the application name of the current print job in process with the application name of a previous print job that has been saved in step S3002 of FIG. 30 (step S3301). If these application names coincide with each other (YES in step S3302), the printer driver 50 sets "always automatic duplex printing" in the return value (step S3303), and the flow returns to the flowchart of FIG. 31. If these application names do not coincide with each other (NO in step S3302), the printer driver 50 refers to the correspondence table between the application and the group (to be described later with reference to FIG. 36), and compares a group to which the application of the current print job in process belongs with a group to which the application of the previous print job belongs (step S3304). If these groups coincide with each other (YES in step S3305), the flow advances to step S3303. If these groups do not coincide with each other (NO in step S3305), the printer driver 50 sets "continuation of automatic determination" in the return value (step S3306), and the flow returns to the flowchart of FIG. 31. In this manner, when the application name of the current print job in process and that of the previous print job are different from each other, but groups to which the respective applications belong coincide with each other, i.e., these applications are of the same type, these print jobs are considered to be a series of print jobs. In this case, the automatic determination process continues.

Figure 34:
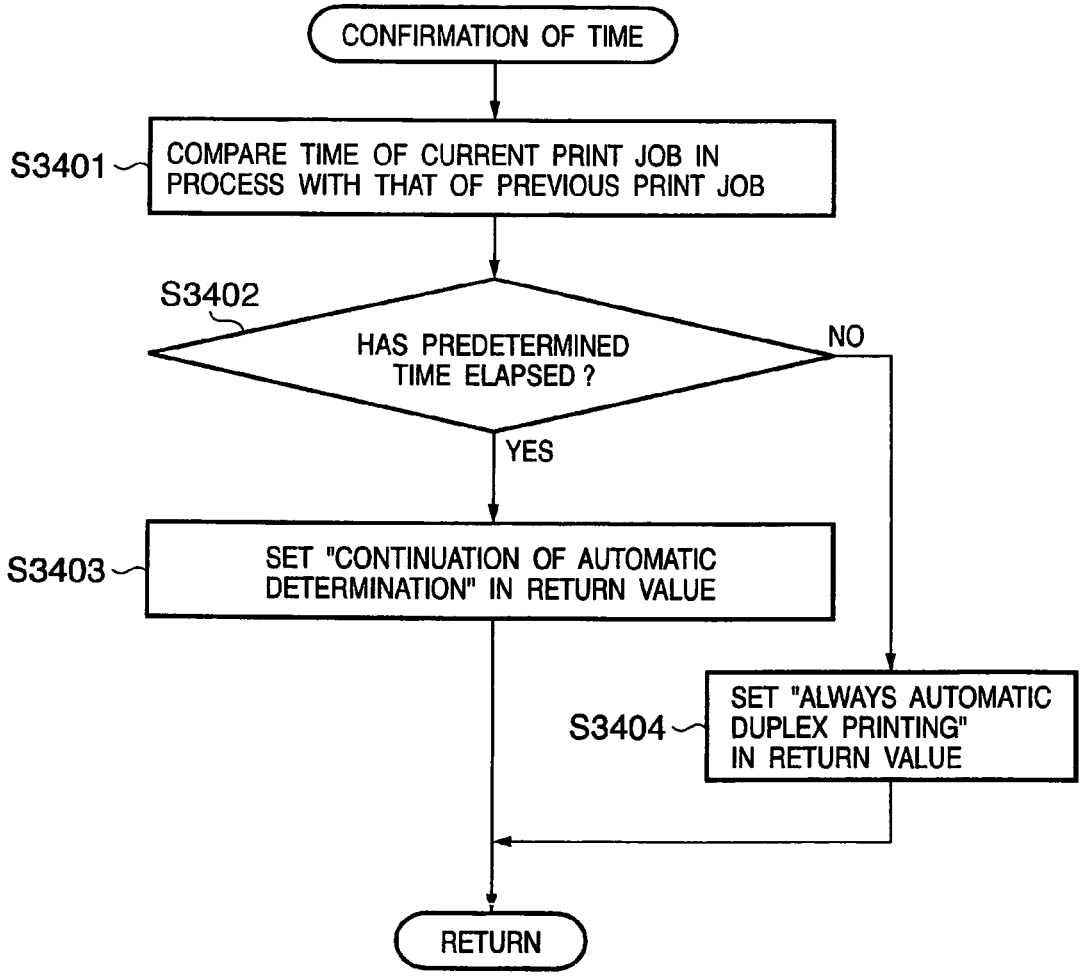
FIG. 34 is a flowchart showing details of a process in step S3105.

FIG. 34 is a flowchart showing details of the process in step S3105. The printer driver 50 compares the time (including the year, month, and day) of the current print job in process with the time (including the year, month, and day) of a previous print job that has been saved in step S3003 of FIG. 30 (step S3401). If a predetermined time has elapsed (YES in step S3402), the printer driver 50 sets "continuation of automatic determination" in the return value (step S3403), and the flow returns to the flowchart of FIG. 31. If the predetermined time has not elapsed yet (NO in step S3402), the printer driver 50 sets "always automatic duplex printing" in the return value (step S3404), and the flow returns to the flowchart of FIG. 31. Note that one minute is defined as the predetermined time.

Figure 35:
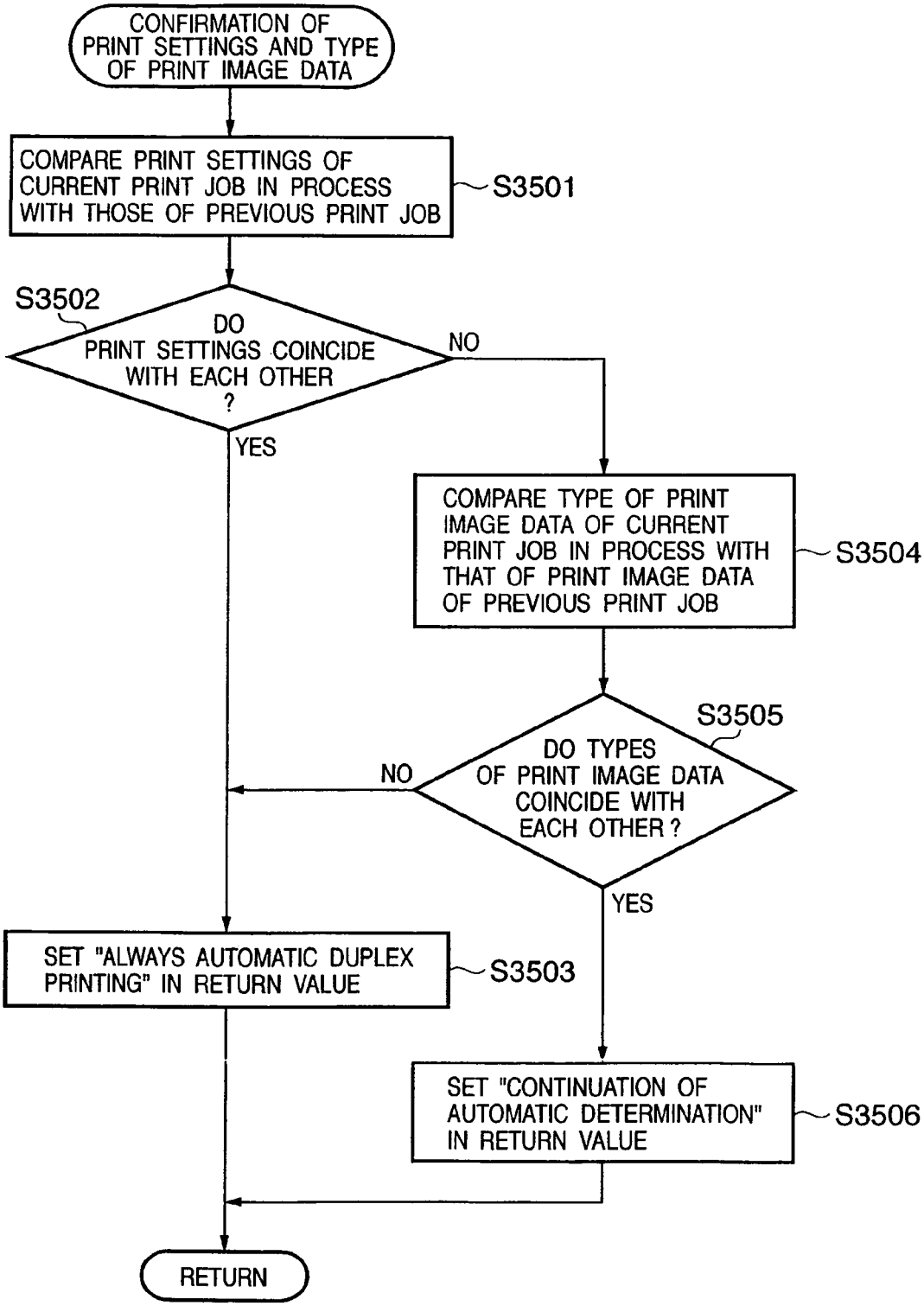
FIG. 35 is a flowchart showing details of a process in step S3107.

FIG. 35 is a flowchart showing details of the process in step S3107. The printer driver 50 compares the print settings of the current print job in process with the print settings of a previous print job that have been saved in step S3004 of FIG. 30 (step S3501). If these print settings coincide with each other (YES in step S3502), the printer driver 50 sets "always automatic duplex printing" in the return value (step S3503), and the flow returns to the flowchart of FIG. 31. If these print settings do not coincide with each other (NO in step S3502), the printer driver 50 compares the type of print image data of the current print job in process with the type of print image data of the previous print job that has been saved in step S3005 of FIG. 30 (step S3504). If these types coincide with each other (YES in step S3505), the printer driver 50 sets "continuation of automatic determination" in the return value (step S3506), and the flow returns to the flowchart of FIG. 31. If these types do not coincide with each other (NO in step S3505), the flow advances to step S3503. Note that the print settings and the type of print image data respectively represent print settings described in the print setting field of the print mode control table in FIG. 16, and the type of print image data described in the print image data field. As described above, even if the print settings of the current print job in process and those of the previous print job are different from each other, and the types of print image data are also different from each other, the print settings generally change in accordance with the print image data. Thus, these print jobs are considered to be a series of print jobs. In this case, the automatic determination process continues.

FIG. 36 shows the correspondence table between the application and the group. An application name is described in the application name field, and a group name to which the application belongs is described in the group name field. For example, both Application 1 and Application 2 belong to Group 1, and are treated as applications of the same type. For example, Application 4 belongs to Group 2, and is treated as an application of a type different from Application 1 and Application 2.

Figure 21:
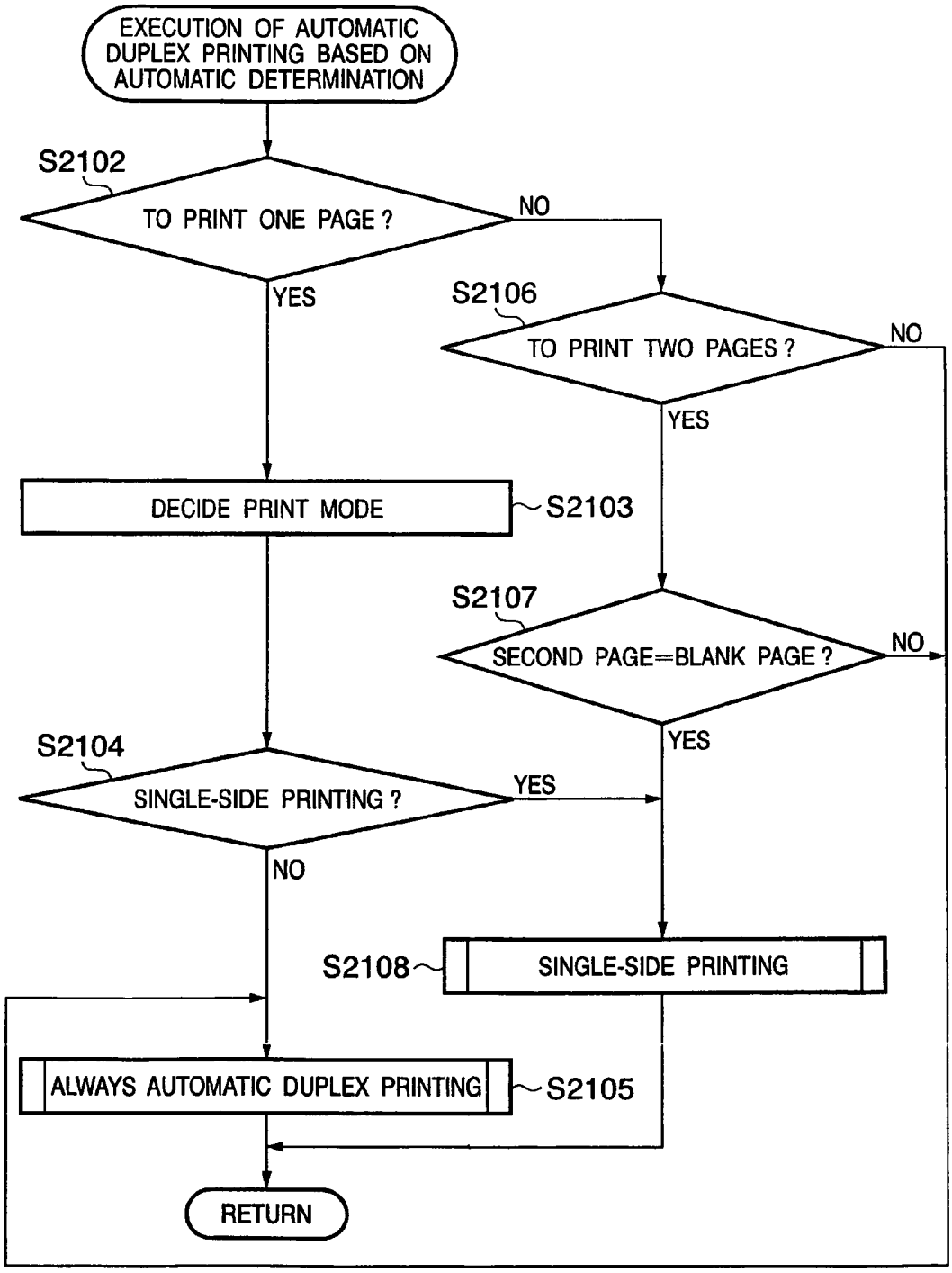
FIG. 21 is a flowchart showing details of a process in step S3109.

FIG. 21 is a flowchart showing details of the process in step S3109. The printer driver 50 analyzes print data stored in the printer queue 32, and checks whether the total print page count 205 of the print data represents one page (step S2102). If the total print page count 205 represents one page, the process advances to step S2103. The printer driver 50 acquires print settings set in the DEVMODE structure, and specifies (decides) a print mode corresponding to a set of print image data and print settings in the print job by using the acquired print settings and the print mode control table shown in FIG. 16 (step S2103). The printer driver 50 checks whether the decided print mode is single-side printing (step S2104). If the print mode is single-side printing, the process advances to step S2108. The printer driver 50 performs the same process as that in step S1708 (i.e., the process complying with the flowchart shown in FIG. 18). Then, the flow returns to the flowchart of FIG. 17.

If the print mode is automatic duplex printing in step S2104, the process advances to step S2105. The printer driver 50 performs the same process as that in step S1711 (i.e., the process complying with the flowchart shown in FIG. 20). Then, the flow returns to the flowchart of FIG. 17.

If the total print page count 205 represents a plurality of pages in step S2102, the process advances to step S2106, and the printer driver 50 checks whether the total print page count 205 represents two pages (step S2106). If the total print page count 205 represents more than two pages, the process advances to step S2105; if the total print page count 205 represents two pages, to step S2107. The graphics driver 34 analyzes print image data in the print job, and checks whether the second page is a blank page (no print image data) (step S2107).

If the second page is a blank page, the process advances to step S2108; if the second page is not a blank page (print image data exists), to step S2106.

By the above process, the CPU 1204 operates the printer driver 50 to allow the operator to select, when printing a print job which is set to automatic duplex printing, one of a mode in which print control is done in accordance with a print image, print settings, and the like based on the print job, a mode in which print control is so done as to always perform duplex printing, and a mode in which print control is so done as to perform either duplex printing or single-side printing in accordance with the number of print pages. In addition, the printer driver 50 can generate a command for causing the printer 3 to perform print control corresponding to the selected mode, and transmit the command to the printer 3.

<Operation of Printer 3>

The operation of the printer 3 will be explained.

Figure 22:
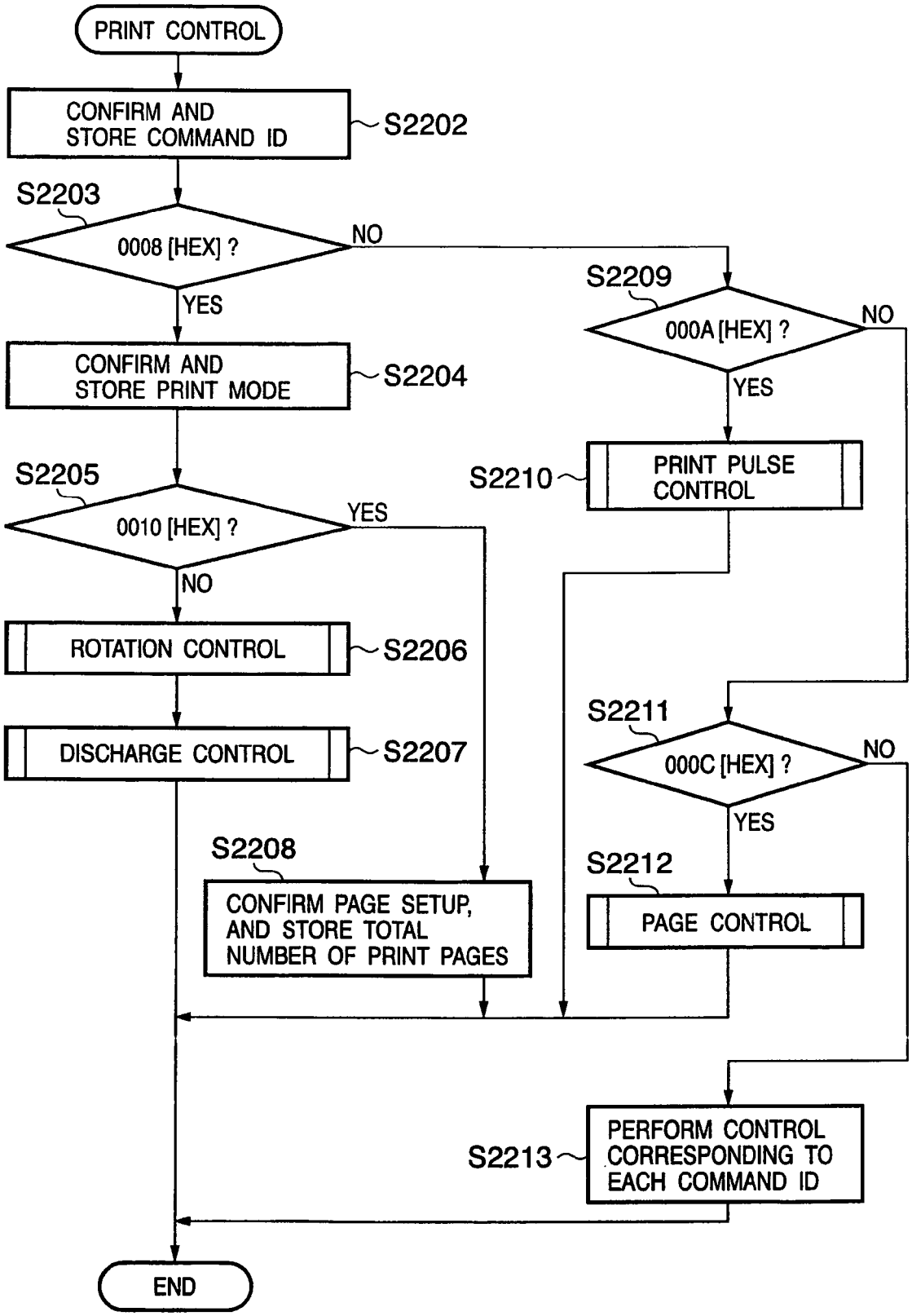
FIG. 22 is a flowchart showing a print process by the printer 3.

FIG. 22 is a flowchart showing a print process by the printer 3. Note that programs and data which cause the CPU 15 to execute the process complying with the flowchart of FIG. 22 are stored in the ROM 16. The CPU 15 executes the process by using the programs and data, and the printer 3 executes each process to be described below.

Command data which is generated by operating the printer driver 50 and sent from the PC 1 via the USB cable 9 is temporarily stored in the RAM 17. First, the command ID in the command is stored in the RAM 17 (step S2202).

Then, it is checked whether the stored command ID is 0008 [HEX] (whether the command received from the PC 1 is the single-side/duplex printing control command shown in FIG. 10) (step S2203). If the command ID is 0008 [HEX], the process advances to step S2204 to store, in the RAM 17, data representing the print mode in the command (step S2204).

It is checked whether the print mode in the command is 0010 [HEX] (whether to perform single-side printing) (step S2205). If the print mode is 0010 [HEX], the process advances to step S2208 to store, in the RAM 17, data representing the page setup in the command (step S2208). Then, the process waits for reception of the next command.

If the print mode is not 0010 [HEX] in step S2205 (manual or automatic duplex printing is set), the process advances to step S2206 to perform a rotation control process (to be described below with reference to FIG. 23) (step S2206) and a discharge control process (to be described below with reference to FIG. 24) (step S2207). Then, the process waits for reception of the next command.

If the command ID is not 0008 [HEX] in step S2203, the process advances to step S2209 to check whether the command ID is 000A [HEX]. If the command ID is 000A [HEX], the process advances to step S2210 to perform a print pulse control process (to be described below with reference to FIG. 25) (step S2210). Then, the process waits for reception of the next command.

If the command ID is not 000A [HEX] in step S2209, the process advances to step S2211 to check whether the command ID is 000C [HEX]. If the command ID is 000C [HEX], the process advances to step S2212 to perform a page control process (to be described below with reference to FIG. 26). Then, the process waits for reception of the next command.

If the command ID is not 000C [HEX] in step S2211, the process advances to step S2213 to perform control corresponding to the command ID (step S2213). Then, the process waits for reception of the next command.

Figure 23:
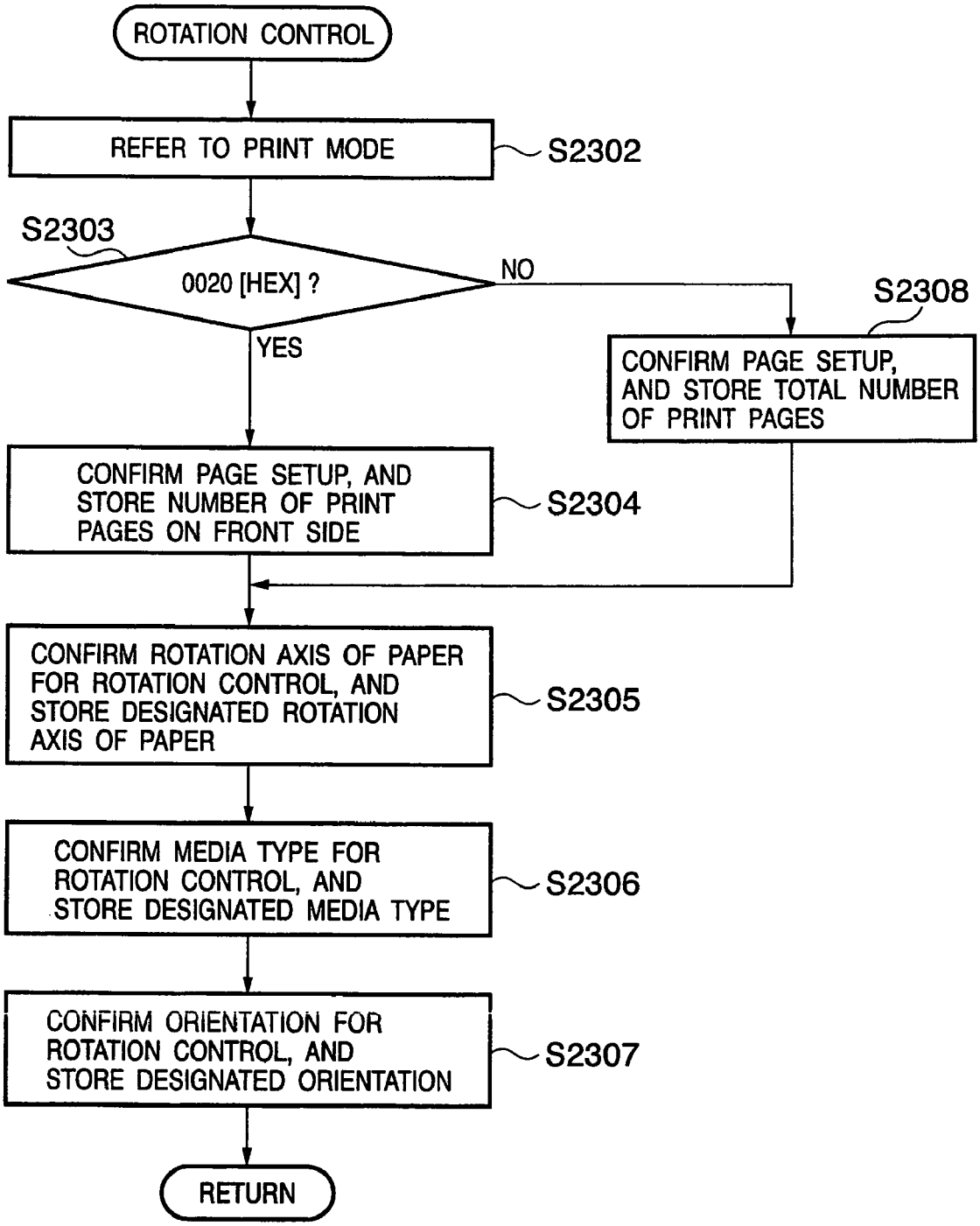
FIG. 23 is a flowchart showing details of a rotation control process in step S2206.

FIG. 23 is a flowchart showing details of the rotation control process in step S2206. The print mode stored in the RAM 17 in step S2204 is referred to (step S2302), and it is checked whether the print mode is 0020 [HEX] (step S2303).

If the print mode is 0020 [HEX], it is manual duplex printing, and the process advances to step S2304. The number of print pages on the front side is stored in the RAM 17 by referring to data representing the page setup in the received single-side/duplex printing control command shown in FIG. 10 (step S2304).

Data representing a designated rotation axis of paper is stored in the RAM 17 by referring to the rotation axis of paper for rotation control in the received command (step S2305). Data representing a designated media type is stored in the RAM 17 by referring to the media type for rotation control in the received command (step S2306). Data representing a designated orientation is stored in the RAM 17 by referring to the orientation for rotation control in the received command (step S2307). Then, the flow returns to the flowchart of FIG. 22.

If the print mode is not 0020 [HEX] in step S2203, it is single-side printing or automatic duplex printing, and the process advances to step S2308. Data representing the total number of print pages is stored in the RAM 17 by referring to the page setup in the received command (step S2308). Then, a process from step S2305 is executed.

Figure 24:
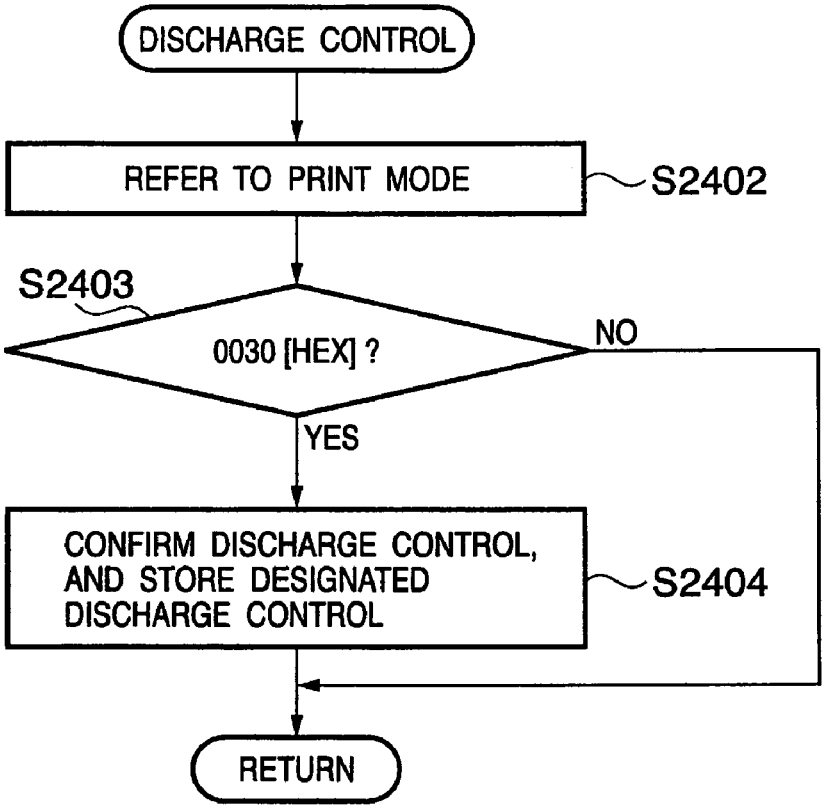
FIG. 24 is a flowchart showing details of a process in step S2207.

FIG. 24 is a flowchart showing details of the process in step S2207. Print mode data stored in the RAM 17 in step S2204 is referred to (step S2402), and it is checked whether the print mode is 0030 [HEX] (step S2403). If the print mode is 0030 [HEX], it is automatic duplex printing, and the process advances to step S2404. By referring to discharge control in the received command, data representing designated discharge control is stored in the RAM 17 (step S2404). Then, the flow returns to the flowchart of FIG. 22.

If the print mode is not 0030 [HEX] in step S2403, it is single-side printing or manual duplex printing, and the flow returns to the flowchart of FIG. 22 without performing the process in step S2404.

Figure 25:
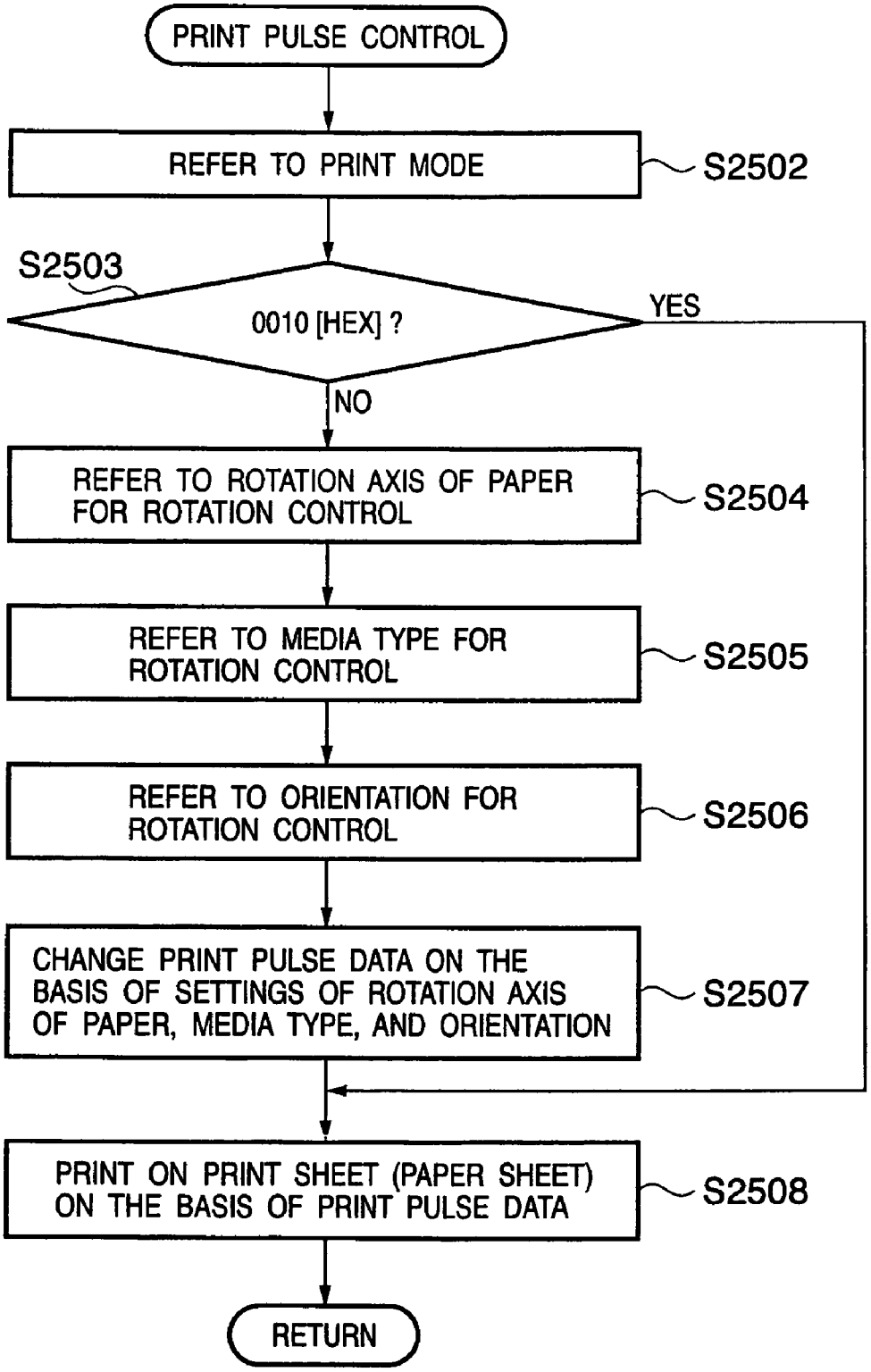
FIG. 25 is a flowchart showing details of a process in step S2210.

FIG. 25 is a flowchart showing details of the process in step S2210. The print mode stored in the RAM 17 in step S2204 is referred to (step S2502), and it is checked whether the print mode is 0010 [HEX] (step S2503). If the print mode is not 0010 [HEX], it is manual or automatic duplex printing, and the process advances to step S2504. The rotation axis of paper for rotation control that has been stored in the RAM 17 in step S2305 is referred to (step S2504). The media type for rotation control that has been stored in the RAM 17 in step S2306 is referred to (step S2505). The orientation for rotation control that has been stored in the RAM 17 in step S2307 is referred to (step S2506).

Print pulse data of the print pulse control command shown in FIG. 11 is changed on the basis of the settings of the rotation axis of paper, media type, and orientation (step S2507). Printing is done on a print sheet (paper sheet) set in the ASF 11 on the basis of the changed print pulse data (step S2508).

If the print mode is 0010 [HEX] in step S2503, it is single-side printing, and the process advances to step S2508. Printing is done on a print sheet (paper sheet) set in the ASF 11 on the basis of print pulse data.

In the embodiment, print pulse data is changed in step S2507 on the basis of the settings of the rotation axis of paper, media type, and orientation. However, the present invention is not limited to this example, and it is also possible and effective to change print pulse data on the basis of arbitrary information on duplex printing control.

Figure 26:
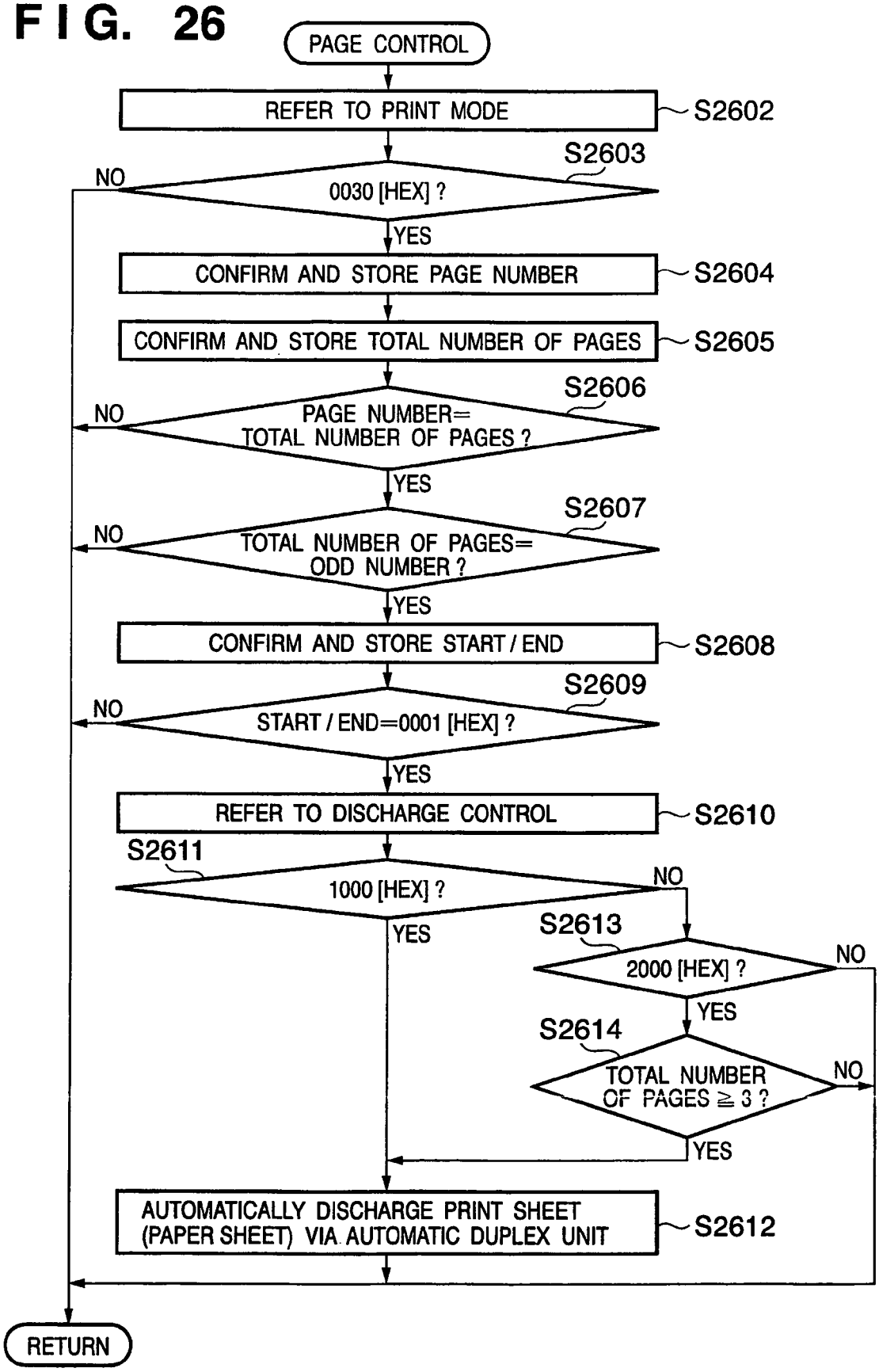
FIG. 26 is a flowchart showing a page control process by the printer 3.

FIG. 26 is a flowchart showing a page control process by the printer 3. Note that programs and data which cause the CPU 15 to execute the process complying with the flowchart of FIG. 26 are stored in the ROM 16. The CPU 15 executes the process by using the programs and data, and the printer 3 executes each process to be described below.

The print mode stored in the RAM 17 in step S2204 is referred to (S2602). It is checked whether the print mode is 0030 [HEX] (step S2603). If the print mode is 0030 [HEX], it is automatic duplex printing, and the process advances to step S2604. Data representing a page number during printing is stored in the RAM 17 by referring to the page number of the page control command shown in FIG. 12 (step S2604). The total number of pages in the page control command shown in FIG. 12 is confirmed, and data representing the value (the total number of print pages or the total number of print pages=unknown) is stored in the RAM 17 (step S2605).

It is checked whether the page number during printing that has been stored in the RAM 17 in step S2604, and the total number of print pages that has been stored in the RAM 17 in step S2605 have the same value (step S2606). If the page number during printing and the total number of print pages have the same value, the process advances to step S2607 to check whether the total number of print pages is an odd number (step S2607). If the total number of print pages is an odd number, the process advances to step S2608. The start/end of the page control command shown in FIG. 12 is referred to, and the value (value representing the start or end) is stored in the RAM 17 (step S2608).

It is checked whether the value stored in the RAM 17 in step S2608 is 0001[HEX] (step S2609). If the value is 0001 [HEX], the process advances to step S2610. Discharge control stored in the RAM 17 in step S2404 is referred to (step S2610). It is checked whether discharge control is 1000 [HEX] (step S2611). If discharge control is 1000 [HEX], the final page is automatically discharged via the automatic duplex unit 10 in the printer 3 when odd-numbered pages are printed. For this purpose, the process advances to step S2612 to automatically discharge a print sheet (paper sheet) via the automatic duplex unit 10 (step S2612). Then, the process returns to the flowchart of FIG. 22.

If discharge control is not 1000 [HEX] in step S2611, the process advances to step S2613 to check whether discharge control is 2000 [HEX] (step S2613). If discharge control is 2000 [HEX], the final page is automatically discharged via the automatic duplex unit 10 in the printer 3 when three or more odd-numbered pages are printed. For this purpose, the process advances to step S2614 to check whether the total number of print pages that has been stored in the RAM 17 in step S2605 is three or more. If the total number of print pages is three or more, the process advances to step S2612 to print and automatically discharge a paper sheet via the automatic duplex unit 10.

The flow returns to the flowchart of FIG. 22 if the print mode is not 0030 [HEX] in step S2603, if the page number during printing that has been stored in the RAM 17 in step S2604 and the total number of print pages that has been stored in the RAM 17 in step S2605 do not have the same value in step S2606, if the total number of print pages is an even number in step S2607, if the value stored in the RAM 17 in step S2608 is not 0001[HEX] in step S2609, if discharge control is not 2000 [HEX] in step S2613, or if the total number of print pages that has been stored in the RAM 17 in step S2605 is smaller than three pages in step S2614.

A process of changing print pulse data in the print pulse control command shown in FIG. 11 on the basis of the settings of the rotation axis of paper, media type, and orientation in step S2507 of FIG. 25 will be instantiated.

FIG. 29 is a view showing part of the memory map of the RAM 17. In FIG. 29, the start address of a print pulse control command is the address 0x80000000 of the RAM 17 of the printer 3, and represents cyan, magenta, yellow, and black print pulse control commands contained in the print pulse control command sent from the PC 1 to the printer 3. FIG. 29 shows a print pulse control command of print image data in which black data of five dots continue from the upper left to the right, and all subsequent data are white (no data). In the print pulse data, a bit at which a print pulse is generated is set, and a bit at which no print pulse is generated is cleared. The final address of the print pulse control command is 0x80008215.

Assume that print image data stored in the memory map shown in FIG. 29 is sent from the PC 1 to the printer 3. The single-side/duplex printing control command designates in advance 3000 [HEX] representing that the rotation axis of paper is a rotation axis perpendicular to the paper surface, 0100 [HEX] representing that the media type is the vertical format, and 0010 [HEX] representing that the orientation is the portrait. In this case, the print pulse data of the print pulse control command is so changed as to obtain a print result in which black data of five successive dots from the upper left to the right are rotated through 180° along an axis perpendicular to the paper surface, and the black data of five dots continue from the lower right to the left. That is, data at an address 0x80006168 is changed from F8 to 00, and data at an address 0x80008215 is changed from 00 to 1F. Printing is done on a print sheet (paper sheet) in accordance with the changed print pulse data.

<Memory Map>

The configuration of a data process program which can be read out by a system comprised of the PC 1 and printer 3 will be explained with reference to the memory map shown in FIG. 28.

Figure 28:
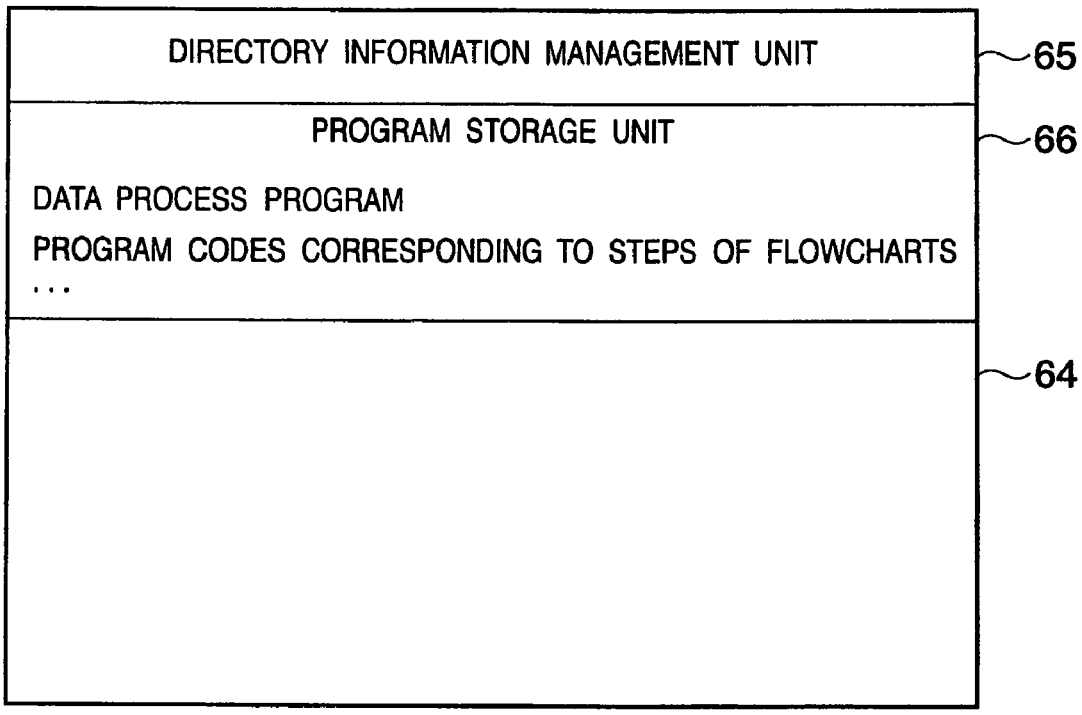
FIG. 28 is a view showing the memory map of a storage medium which stores various data process programs that can be read out by a system.

FIG. 28 is a view showing the memory map of a storage medium which stores various data process programs that can be read out by the system. Although not shown, information (e.g., version information and creator information) for managing programs stored in the storage medium may also be stored in the storage medium. Further, information depending on an OS or the like on the program reading side, such as an icon for identifiably displaying a program, may also be stored.

In FIG. 28, reference numeral 64 denotes a storage medium which is formed from the hard disk drive (HDD) 1202 of the PC 1 and the ROM 16 of the printer 3. Reference numeral 65 is a directory information management unit which manages data subordinate to various programs. Reference numeral 66 denotes a program storage unit which stores a program for installing various programs in an information processing apparatus (PC 1), a program for decompressing a program when a program to be installed is compressed, or a program for controlling the printer 3.

Functions which can be implemented by executing the flowcharts of the processes shown in FIGS. 17 to 21 and 30 to 35 in the printer driver 50 or the flowcharts of the processes shown in FIGS. 22 to 26 in the printer 3 may be implemented by the information processing apparatus (PC 1) or printer 3 in accordance with externally installed programs.

In this case, the present invention can be applied to even a case wherein pieces of information containing programs are supplied to the PC 1 and printer 3 from a storage medium (e.g., a CD-ROM, flash memory, or flexible disk) or an external storage medium via a network.

The object of the present invention is achieved even by supplying a recording medium (or storage medium) which records software program codes to implement the functions of the above-described embodiment to the system or apparatus and causing the computer (or CPU or MPU) of the system or apparatus to read out and execute the program codes stored in the recording medium. In this case, the program codes read out from the recording medium implement the functions of the above-described embodiment by themselves, and the recording medium which records the program codes constitutes the present invention.

The functions of the above-described embodiment are implemented not only when the readout program codes are executed by the computer but also when the operating system (OS) running on the computer performs some or all of actual processes on the basis of the instructions of the program codes.

The functions of the above-described embodiment are also implemented when the program codes read out from the recording medium are written in the memory of a function expansion card inserted into the computer or a function expansion unit connected to the computer, and the CPU of the function expansion card or function expansion unit performs some or all of actual processes on the basis of the instructions of the program codes.

When the present invention is applied to the recording medium, the recording medium stores program codes corresponding to the above-described flowcharts.

In the embodiment, rotation control is performed by changing print pulse data by print pulse control in the printer 3 in accordance with a value designated by rotation control of the single-side/duplex printing control command generated by the printer driver 50. However, the present invention is not limited to this example. For example, a system which can provide the same print result can be implemented by performing rotation control by the graphics driver 34 of the printer driver 50.

The embodiment adopts a color ink-jet printer as the printer 3, but the present invention is not limited to this. For example, an arbitrary printer such as a monochrome LBP can be used. The printer 3 is not limited to a single apparatus, and may be applied as a print mechanism part of a multi-functional peripheral.

Instead of the PC 1, an arbitrary terminal (e.g., a DVD video player, game machine, set-top box, or Internet appliance) which can be used in the above-described way may be employed.

The OS is not limited to Windows XP®. When another OS is used, application software, dialogs, the operation method of the software, and the like depend on the OS.

In the embodiment, the PC 1 and printer 3 are connected using a USB cable. However, the present invention is not limited to this, and may use an arbitrary communication means such as Ethernet®, wireless LAN, IEEE1394, Bluetooth, IrDA, parallel interface, or serial interface.

According to the embodiment, in the automatic duplex printing process based on automatic determination shown in FIG. 31, when the result of "confirmation of the user name"→"confirmation of the application name"→"confirmation of the time"→"confirmation of print settings and the type of print image data" represents continuation of automatic determination, the process (FIG. 21) of executing automatic duplex printing based on automatic determination is performed. However, the present invention is not limited to this example. For example, when no user name need be confirmed in accordance with the use environment, the process is executed from step S3103 in FIG. 31 without performing the processes in steps S3101 and S3102. Optimal automatic duplex printing based on automatic determination can be efficiently achieved in accordance with the use environment.

In order to unify the front/back sides of successive jobs for the same user, only S3101, S3102, S3109, and S3110 in FIG. 31 are executed.

In order to unify the front/back sides of successive jobs in a predetermined time, only S3105, S3106, S3109, and S3110 in FIG. 31 are executed.

In order to unify the front/back sides of successive jobs in a predetermined time for the same user, S3101 and S3102 in FIG. 31 are first executed. If NO in S3102, S3105 and S3106 are executed; if YES in S3102, the flow advances to step S3109. If NO in S3106, the flow advances to S3110; if YES in S3106, to S3109.

The priority order of the confirmation processes in the automatic determination process can also be changed by, e.g., exchanging the processes in steps S3105 and S3101. By this control, an optimal confirmation process can be efficiently performed in accordance with the use environment. As a process other than the above-described confirmation processes, arbitrary confirmation work which achieves the same purpose can be exploited to perform the automatic duplex printing process based on automatic determination.

From the above description, the embodiment can obtain the following effects.

(1)

Even if a document of one page is printed at automatic duplex printing setting by erroneous user operation, printing can be done by analyzing print image data in a print job and automatically deciding a print mode (single-side printing or automatic duplex printing) optimal for image data from the analysis result and print settings in the print job. The operability improves, and the best print result expected by the user can be attained.

(2)

In automatic duplex printing for one page, some applications output the second page as a blank page (no print image data). This case can be automatically determined from print image data and the total number of print pages in a print job, and the print process is done as single-side printing for one page. Hence, the operability improves, and a high-quality print result can be attained at high speed.

(3)

In (1) and (2), optimal discharge control is executed by automatically determining whether the print job is treated as one of a series of print jobs in automatic duplex printing, or a print job in general single-side printing that is contained in a plurality of print jobs in automatic duplex printing. An optimal print result which meets the print purpose can be obtained, and handling of a printed product becomes easy.

(4)

In (1) and (2), an optimal image process is performed by automatically determining whether the print job is treated as one of a series of print jobs in automatic duplex printing, or a print job in general single-side printing that is contained in a plurality of print jobs in automatic duplex printing. An optimal print result which meets the print purpose can be obtained.

In the embodiment of the present invention, the present invention is implemented by a printer driver in a personal computer. However, a printer may be equipped with a controller, which implements the process of the printer driver.

As many apparently widely different embodiments of the present invention can be made without departing from the spirit and scope thereof, it is to be understood that the invention is not limited to the specific embodiments thereof except as defined in the appended claims.

This application claims the benefit of Japanese Application Nos. 2005-071734, filed Mar. 14, 2005, and 2006-034319, filed Feb. 10, 2006 which are hereby incorporated by reference herein in their entirety.

What is claimed is:

1. An information processing apparatus, comprising:

a designation unit that designates one of an automatic duplex printing process based on an automatic determination and an always automatic duplex printing process, wherein the automatic duplex printing process based on an automatic determination is that single-side printing or duplex printing is performed according to a print setting, wherein the always automatic duplex printing process is that duplex printing is performed regardless of the print setting;

a first comparison unit that compares a user name of a current print job in process with that of a previous print job, when said designation unit designates the automatic duplex printing process based on an automatic determination;

a unit that causes a printer to perform the always automatic duplex printing process, if the user name of the current print job in process is identical with that of the previous print job;

a second comparison unit that compares the print setting of the current print job in process with that of the previous print job, if the user name of the current print job in process is different from that of the previous print job; and a second unit that causes the printer to perform the always automatic duplex printing process if the print setting of the current print job in process is identical with that of the previous print job, and causes the printer to perform the automatic duplex printing process based on an automatic determination if the print setting of the current print job in process is different from that of the previous print job.

2. The apparatus according to claim 1, wherein said second unit compares a type of the current print job in process with that of the previous print job if the print setting of the current print job in process is different from that of the previous print job, causes the printer to perform the always automatic duplex printing process if the type of the current print job in process is different from that of the previous print job, and causes the printer to perform the automatic duplex printing process based on an automatic determination if the type of the current print job in process is identical with that of the previous print job.

3. An information processing method, comprising:

a designation step of designating one of an automatic duplex printing process based on an automatic determination and an always automatic duplex printing process, wherein the automatic duplex printing process based on an automatic determination is that single-side printing or duplex printing is performed according to a print setting, wherein the always automatic duplex printing process is that duplex printing is performed regardless of the print setting;

a first comparison step of comparing an application name of a current print job in process with that of a previous print job, when the automatic duplex printing process based on an automatic determination is designated in the designation step;

a step of causing a printer to perform the always automatic duplex printing process, if the application name of the current print job in process is identical with that of the previous print job;

a second comparison step of comparing the print setting of the current print job in process with that of the previous print job, if the application name of the current print job in process is different from that of the previous print job; and a second step of causing the printer to perform the always automatic duplex printing process if the print setting of the current print job in process is identical with that of the previous print job, and causing the printer to perform the automatic duplex printing process based on an automatic determination if the print setting of the current print job in process is different from that of the previous print job.

4. The method according to claim 3, wherein the second step includes a step of comparing a type of the current print job in process with that of the previous print job if the print setting of the current print job in process is different from that of the previous print job, causing the printer to perform the always automatic duplex printing process if the type of the current print job in process is different from that of the previous print job, and causing the printer to perform the automatic duplex printing process based on an automatic determination if the type of the current print job in process is identical with that of the previous print job.

5. A non-transitory computer-readable storage medium storing a computer program for causing a computer to execute:

a designation step of designating one of an automatic duplex printing process based on an automatic determination and an always automatic duplex printing process, wherein the automatic duplex printing process based on an automatic determination is that single-side printing or duplex printing is performed according to a print setting, wherein the always automatic duplex printing process is that duplex printing is performed regardless of the print setting;

a first comparison step of comparing a printing time of a current print job in process with that of a previous print job, when the automatic duplex printing process based on an automatic determination is designated in the designation step;

a step of causing a printer to perform the always automatic duplex printing process, if a difference between the printing time of the current print job in process and that of the previous print job is equal to or shorter than a predetermined period;

a second comparison step of comparing the print setting of the current print job in process with that of the previous print job, if the difference is longer than the predetermined period; and a second step of causing the printer to perform the always automatic duplex printing process if the print setting of the current print job in process is identical with that of the previous print job, and causing the printer to perform the automatic duplex printing process based on an automatic determination if the print setting of the current print job in process is different from that of the previous print job.

6. The medium according to claim 5, wherein the second step includes a step of comparing a type of the current print job in process with that of the previous print job if the print setting of the current print job in process is different from that of the previous print job, causing the printer to perform the always automatic duplex printing process if the type of the current print job in process is different from that of the previous print job, and causing the printer to perform the automatic duplex printing process based on an automatic determination if the type of the current print job in process is identical with that of the previous print job.

* * * * *